US008910335B2

(12) United States Patent
Kim et al.

(10) Patent No.: US 8,910,335 B2
(45) Date of Patent: Dec. 16, 2014

(54) WASHING MACHINE AND METHOD OF CONTROLLING WASHING MACHINE

(75) Inventors: Youngjong Kim, Seoul (KR); Taechul Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 371 days.

(21) Appl. No.: 13/228,147

(22) Filed: Sep. 8, 2011

(65) Prior Publication Data

US 2012/0060299 A1 Mar. 15, 2012

(30) Foreign Application Priority Data

| | | |
|---|---|---|
| Sep. 14, 2010 | (KR) | 10-2010-0090155 |
| Sep. 14, 2010 | (KR) | 10-2010-0090156 |
| Sep. 15, 2010 | (KR) | 10-2010-0090764 |
| Sep. 29, 2010 | (KR) | 10-2010-0094613 |
| Nov. 11, 2010 | (KR) | 10-2010-0112254 |
| Mar. 3, 2011 | (KR) | 10-2011-0019134 |
| Mar. 3, 2011 | (KR) | 10-2011-0019135 |

(51) Int. Cl.

| | |
|---|---|
| ***D06F 35/00*** | (2006.01) |
| ***D06F 21/08*** | (2006.01) |
| ***D06F 37/24*** | (2006.01) |
| ***D06F 37/20*** | (2006.01) |
| ***D06F 39/00*** | (2006.01) |
| ***D06F 23/04*** | (2006.01) |

(52) U.S. Cl.

CPC ..... *D06F 39/003* (2013.01); *D06F 21/08* (2013.01); *D06F 37/24* (2013.01); *D06F 37/203* (2013.01); *D06F 23/04* (2013.01)

USPC ..... 8/158; 8/159

(58) Field of Classification Search

CPC ..... D06F 35/005

See application file for complete search history.

(56) References Cited

U.S. PATENT DOCUMENTS

| | | | | |
|---|---|---|---|---|
| 5,165,260 | A * | 11/1992 | Geiger | 68/12.04 |
| 5,507,055 | A * | 4/1996 | Blauert et al. | 8/159 |
| 2007/0068032 | A1 * | 3/2007 | Bringewatt et al. | 34/318 |
| 2010/0154131 | A1 * | 6/2010 | Paul et al. | 8/159 |

* cited by examiner

*Primary Examiner* — Jason Ko

(74) *Attorney, Agent, or Firm* — McKenna Long & Aldridge LLP

(57) ABSTRACT

A method of controlling a washing machine is provided. A first laundry load is first detected based on a rotational property of a pulsator. A second laundry load is detected based on a property that varies in accordance with a vertical load applied from a tub. Finally, it is determined if laundry loaded in the drum is in a dry state or a wet state by comparing the first laundry load with the second laundry load.

14 Claims, 30 Drawing Sheets

A50

WASHING MACHINE AND METHOD OF CONTROLLING WASHING MACHINE

CROSS-REFERENCE TO RELATED APPLICATIONS

This application claims priority from Korean Patent Application No. 10-2010-0090155 filed in Korea on Sep. 14, 2010, No. 10-2010-0090156 filed in Korea on Sep. 14, 2010, No. 10-2010-0090764 filed in Korea on Sep. 15, 2010, No. 10-2010-0094613 filed in Korea on Sep. 29, 2010, No. 10-2010-0112254 filed in Korea on Nov. 11, 2010, No. 10-2011-0019134 filed in Korea on Mar. 3, 2011, No. 10-2011-0019135 filed in Korea on Mar. 3, 2011, the contents of which are incorporated herein by reference for all purposes as if fully set forth herein.

BACKGROUND

1. Field

Exemplary embodiments of the invention relate to a washing machine and a method of controlling the washing machine.

2. Background

In general, a washing machine is designed to wash the laundry using emulsification of a detergent, a water stream action generated by the rotation of washing blades or washing tub, and an impact action applied by the washing blades. The washing machine performs washing, rinsing, and/or spinning to remove contaminant from the laundry by using an action between water and the detergent.

The washing machine includes a tub for storing the water and a drum that is rotatably provided in the tub and in which the laundry is loaded. The tub is disposed such that it is suspended from an inner top of a casing that is referred to as a main body, a cabinet, a casing or the like that defines the appearance of the washing machine. In order for the tub to be suspended from and be supported by the inner top of the casing, a tub supporting member connecting the tub to the casing is provided.

A washing machine may detect a laundry load, after which it performs the washing, rinsing, or spinning in accordance with a preset pattern depending on the detected laundry load. The laundry load detection is performed in an indirect method based on a rotational property of a pulsator that varies in accordance with the laundry load.

For example, when the pulsator rotates in a state where the laundry is loaded in the drum, the load applied to a driving unit driving the pulsator is relatively high in a relatively large amount of laundry load. On the contrary, in a relatively small amount of laundry load, the load applied to the driving unit is relatively low. Therefore, the rotational property of the driving unit may vary in accordance with the laundry load and thus the laundry load may be detected in accordance with the rotational property.

However, because the above-described method is an indirect method in which the rotational property of the pulsator is observed and the laundry load is assumed based on the observed rotational property, it is impossible to accurately measure the laundry load. Likewise, the accuracy of detection of a degree of unbalance of the laundry is deteriorated.

For example, when the laundry gets tangled in the drum, the rotation of the pulsator cannot be smoothly realized even when a small amount of the laundry is loaded in the tub. Therefore, it may be erroneously detected that a large amount of the laundry is loaded. In addition, when wet laundry is loaded in the drum, the measured laundry load may appear greater in comparison to the same load, if that load was dry. Therefore, there is a need to devise a method that can more accurately detect the laundry load.

FIG. 15 is a washing machine according to the prior art. The washing machine includes a casing 1 defining an appearance of the washing machine, a water tank (or tub) 2 disposed in the casing 1, and a drum 3 that is rotatably provided in the tub 2. A pulsator 4 is provided under the drum 3. The drum 3 and the pulsator 4 are connected to and driven by a vertical washing shaft 13*a* connected to a driving unit 13.

The casing 1 is formed in a rectangular parallelepiped box shape and provided with a door through which the laundry is loaded and unloaded. The tub 2 is formed in a cylindrical shape having an opened top and suspended in the casing 1 by a supporting member 152.

The supporting member 152 may be provided with a load cell 220. The load cell 220 is a sensor that can detect weight using tensile force. The load cell 220 is illustrated in an enlarged state in a circled portion of FIG. 1. In FIG. 1, the supporting member 152 is divided into upper and lower bars 152*a* and 152*b* and the load cell 220 may be mounted between the upper and lower bars 152*a* and 152*b*.

As illustrated in FIG. 15, in order to effectuate the coupling of the supporting member 152 to the load cell 220, an end portion 152*c* of the upper bar 152*a* is bent and connected to the load cell 220. However, in this configuration, vibration generated by the rotation of the drum 3 is transferred to the bent end portion 152*c* and acts to unfold the bent end portion 152*c* and thus the coupling of the supporting member 152 and the load cell 220 may be released.

Alternatively, a screw thread (not shown) may be formed on an end portion of the upper bar and screw-coupled to the load cell. However, in the prior art, the screw threads in the upper and lower supporting bars have the same direction, in such a configuration, the screw-coupling may be released by a rotational force transferred by the rotation of the drum 3.

SUMMARY OF THE INVENTION

Accordingly, the invention is directed to a washing machine and a method of controlling the washing machine that substantially obviates one or more of the above mentioned problems, which are due to limitations and disadvantages of the prior art.

An advantage of the invention is to provide a method of controlling a washing machine that can provide optimal washing performance by applying different washing patterns in accordance with a determined result of whether the laundry loaded in the drum is dry laundry (e.g., little to no water content) or wet laundry. With knowledge of this information, the water and electric consumption of the washing machine can be reduced and the wear of the laundry can be reduced as compared with the prior art control method where the washing pattern is determined in accordance with the wet laundry load detected in a state where wet laundry is loaded.

Another advantage of the invention is to provide a washing machine that can stably maintain the coupling of the supporting member and the weight detecting sensor using adaptor having screw threads having different thread directions.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

To achieve these and other advantages and in accordance with the purpose of the invention, as embodied and broadly described, a method of controlling a washing machine including a casing, a tub suspended in the casing, a drum rotatably provided in the tub, and a pulsator rotatably provided in the drum may include: detecting a first laundry load based on a rotational property of the pulsator; detecting a second laundry load based on a property that varies in accordance with a vertical load applied by the tub; determining if laundry loaded in the drum is in a dry state or a wet state by comparing a first laundry load with a second laundry load.

In yet another aspect of the invention, a washing machine includes: a casing; a tub disposed in a casing; a drum which is rotatably provided inside the tub and in which laundry is loaded; at least one supporting member suspending the tub in the casing and comprising upper and lower bars; a weight detecting sensor provided between the upper and lower bars and configured to detect a weight of the laundry; and at least one adaptor, coupling one of the upper and lower bars to the weight detecting sensor, wherein the adaptor includes: a sensor coupling portion to which the weight detecting sensor is coupled; and a supporting member coupling portion to which one of the upper and lower bars is coupled, wherein the sensor coupling portion and the supporting member coupling portion are formed with respective screw threads having different thread directions.

It is to be understood that both the foregoing general description and the following detailed description are exemplary and explanatory and are intended to provide further explanation of the invention as claimed.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to embodiments of the invention, examples of which are illustrated in the accompanying drawings. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. Wherever possible, the same reference numbers will be used throughout the drawings to refer to the same or like parts.

Figure 1:
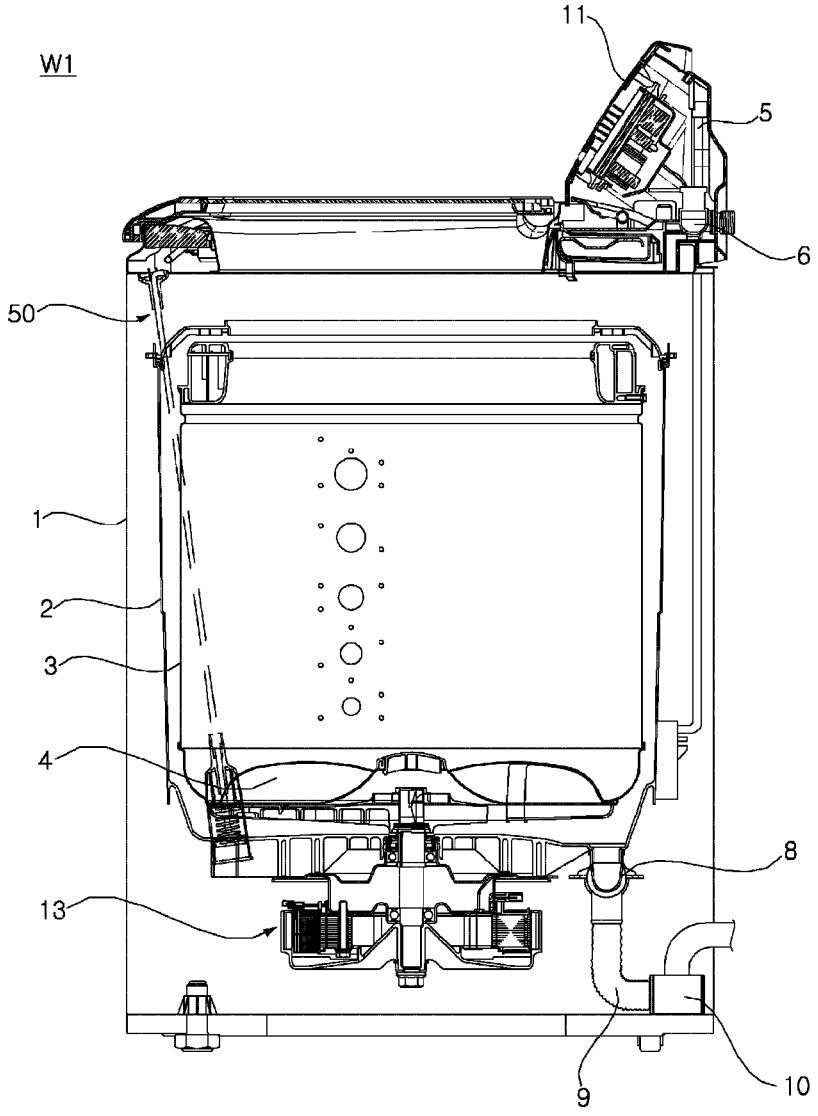
FIG. 1 is a schematic cross-sectional view of a washing machine according to an embodiment of the invention.
Figure 2:
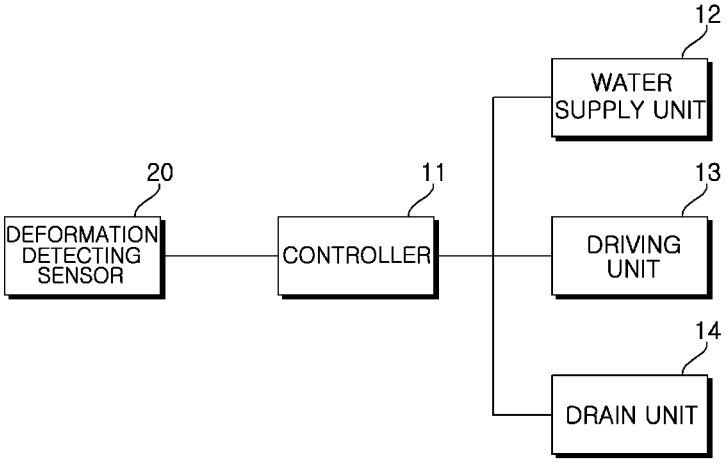
FIG. 2 is a block diagram illustrating a control relationship between parts of a washing machine according to an embodiment of the invention.

FIG. 1 is a schematic cross-sectional view of a washing machine according to an embodiment of the invention. FIG. 2 is a block diagram illustrating a control relationship between parts of a washing machine according to an embodiment of the invention.

Referring to FIGS. 1 and 2, a washing machine W1 according to an embodiment of the invention includes a casing 1 defining the appearance of the washing machine W1, a tub 2 that is provided inside the casing 1 and configured to store wash water, a drum 3 that is rotatably provided inside the tub 2 and in which laundry is loaded, a pulsator 4 that is rotatably provided on a bottom of the drum 3, a driving unit 13 for driving the drum 3 and/or the pulsator 4, a water supply unit 12 configured to supply the wash water into the tub 2 and drum 3, a draining unit 14 configured to drain the wash water out of the tub 2 and the drum 3, and a tub suspension 50 configured to support the tub 2 from an inner wall of the casing 1.

The water supply unit 12 may include a water supply valve 6 configured to control a water supply passage 5 along which the wash water supplied by an external water source flows. The drain unit 14 may include a drain valve 8 for controlling a drain passage 9 through which the wash water is drained out of the tub 2 and the drum 3 and a drain pump 10 for pumping out the wash water from the washing machine.

The tub suspension 50 is designed to have one end connected to the tub 2 and the other end connected to the casing 1 so that the tub 2 can be suspended from an inner wall of the casing 1. The tub suspension 50 does not require a damping structure for damping vibration. Accordingly, although the tub suspension 50 will be described as including a damping structure, it should be understood that the tub suspension 50 could be viewed as a member that allows the tub 2 to be suspended from the inner wall of the casing 1.

The tub suspension 50 has one end connected to the casing 1 by a tub support mount 30 and the other end connected to a lower-outer circumference of the tub 2. In one embodiment, the tub suspension 50 includes a damping structure configured to damp vibration generated when the drum 3 and/or the pulsator 4 is rotated by a driving unit 13. As noted above, the damping structure is not a requirement of the invention. The structure of the tub suspension 50 will be described in more detail later.

Figure 3:
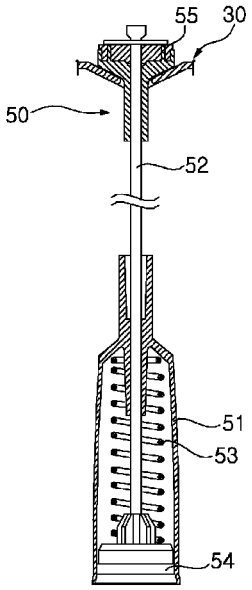
FIG. 3 is a cross-sectional view of a suspension of the washing machine according to an embodiment of the invention.

FIG. 3 is a cross-sectional view of the tub suspension 50 of the washing machine according to an embodiment of the invention. Referring to FIG. 3, the tub suspension 50 includes a damper cap 51 that is installed on the lower-outer circumference of the tub 2 and cooperates with the tub 2, a pivot 55 mounted on the tub support mount 30 fixed in the casing 1, a supporting member 52 having one end penetrating the damper cap 51 and the other end coupled to the pivot 55, a damper spring 53 that is installed in the damper cap 51 to absorb the vibration generated by the tub 2, and a damper base 54 that is installed in a lower opening of the damper cap 51 to support the supporting member 52 and the damper spring 53.

When the damper cap 51 together with the tub 2 vibrates in a vertical direction, the vibration is damped by not only viscous damping generated when air is exhausted through an air hole (not shown) of the damper camp 51 but also frictional damping generated by friction between the damper cap 51 and the damper base 54.

An upper end of the supporting member 52 penetrates the pivot 55 and is exposed to a top surface of the pivot 55. Here, in order to prevent the upper end of the supporting member 52 from being separated from the pivot 55, the upper end of the supporting member 52 may be secured by a flexible adhesive or a special member, such as a nut, may be used.

The tub support mount 30 may be integrally formed with the casing 1. However, as described below, it may be also possible to from the tub support mount 30 separately from the casing and fix the tub support mount 30 on an inner wall of the casing 1. One tub support mount 30 may be disposed on each of the four corners of the casing 1.

Figure 4A:
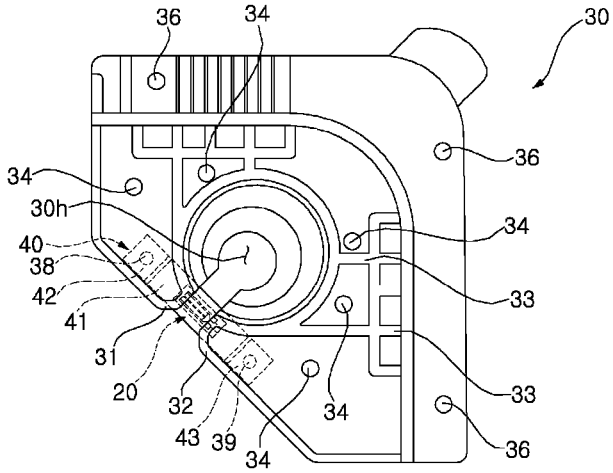
FIG. 4A is a top view illustrating a structure where a deformation member and a deformation detecting sensor are installed on a tub support mount on which a suspension is mounted and installed according to an embodiment of the invention.
Figure 4B:
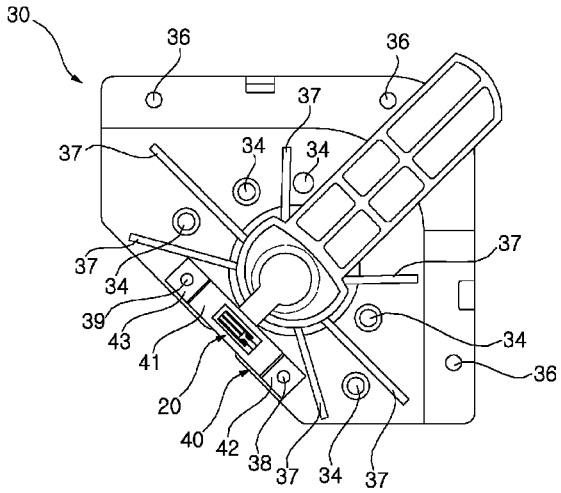
FIG. 4B is a bottom view illustrating a coupling state of the suspension and deformation member of FIG. 4A.

FIG. 4A is a top view illustrating a structure where a deformation member 40 according to an embodiment of the invention. FIG. 4B is a bottom view illustrating a coupling state of the suspension 50 and deformation member of FIG. 4A.

Referring to FIGS. 4A and 4B, the tub support mount 30 is provided with a mounting hole 30*h* through which the supporting member 52 passes. A portion of the mounting hole 30*h* is cut and a deformation member 40 is installed on both ends 31 and 32 of the cut portion of the mounting hole 30*h*. A degree of the widening between the both ends 31 and 32 of the mounting hole 30*h* varies in accordance with a degree of the load applied by the tub 2 through the supporting member 52. Therefore, a degree of deformation of the deformation member 40, which is fixed on the both ends 31 and 32 of the cut portion, also varies.

The washing machine W1 detects laundry load by measuring the strain of the deformation member 40, which is deformed by tensile force generated as the distance between both ends 31 and 32 of the cut portion of the mounting hole 30*h* is widened.

The strain of the deformation member 40 may be detected by a deformation detecting sensor 20. For example, a strain gauge may be used as the deformation detecting sensor 20. A strain gauge measures the strain of an object to be measured by using a pressure resistance effect, where a resistance value of a resistance member such as metal or a semiconductor varies when deformation is applied to the resistance member. Because the deformation member 40 is tensioned in a widening direction of both ends 31 and 32 of the cut portion of the tub support mount 30, the deformation detecting sensor 20 may detects normal strain of the deformation member 40. Hereinafter, the deformation detecting sensor 20 will be referred to as the strain gauge 20.

As shown in FIGS. 4A and 4B, the deformation member 40 is mounted on a lower portion of the tub support mount 30 by coupling members 38 and 39 such as screws, bolts, and the like.

The strain gauge 20 is coupled to both ends 31 and 32 of the cut portion of the tub support mount 30 by the coupling members 38 and 39 and attached to a connecting portion 41 interconnecting first and second restraining ends 42 and 43 that are respectively located at both ends 31 and 32. The strain gauge 20 is configured to measure the strain of the connecting portion 41 in a length direction.

In order for the tub support mount 30 to have sufficient strength against the load transferred from the supporting member 52, a rib 33 may be formed on a top surface of the tub support mount 30. Drain holes 34 for draining splattered wash water are formed through a portion surrounded by the rib 33. In addition, a plurality of ribs 37 for enhancing rigidity may be formed to extend from the mounting hole 30*h* on a bottom surface of the tub support mounting unit 30. Coupling holes 36 through which coupling members such as screws, bolts, and the like pass may be formed around the tub support mount 30. The coupling members 38, 39 may be coupled to the casing 1 through the coupling holes (not shown, but similar to 36).

Figure 5:
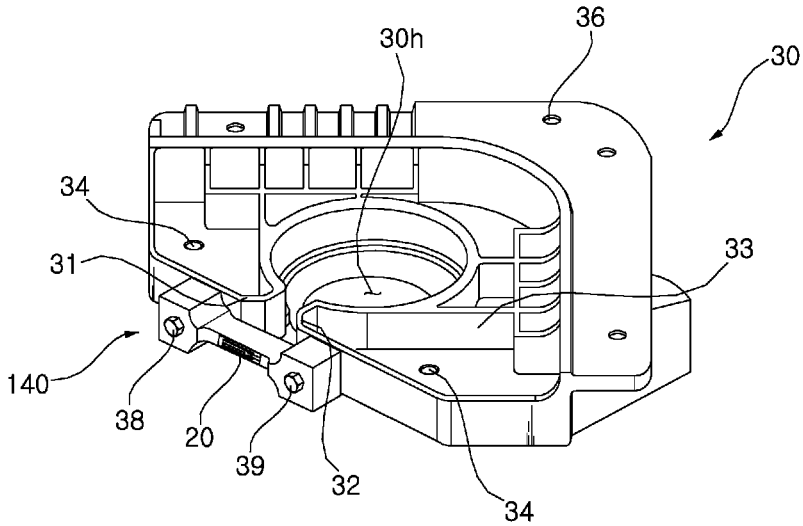
FIG. 5 is a perspective view of a structure where a deformation member and a deformation detecting sensor are installed on a tub support mount on which the suspension of FIG. 3 is mounted according to another embodiment of the invention.

FIG. 5 is a perspective view of a structure where a deformation member and a deformation detecting sensor are installed on a tub support mount on which the suspension of FIG. 3 is mounted according to another embodiment of the invention. FIGS. 6A, 6B, 6C, and 6D are views illustrating the deformation member of FIG. 5.

Unlike the deformation member illustrated in FIGS. 4A and 4B, a deformation member 140 of the embodiment illustrated in FIG. 5 is coupled on front portions of both ends 31 and 32 of a cut portion of the tub support mount 30. In order for the deformation member 140 to be disposed on a portion where a widening degree of both ends of the cut portion of the tub support mount 30 is greatest, the deformation member 140 may be mounted on a front-outer circumference of the tub support mount 30.

Referring to FIGS. 6A, 6B, 6C, and 6D, the deformation member 140 includes first and second restraining ends 142 and 143 that are respectively fixed on both ends 31 and 32 of the cut portion of the tub support mount 30 by coupling members 38 and 39 such as screws, bolts, and the like and a connecting portion 141 that extends in a direction connecting the first restraining end 142 to the second restraining end 143 interconnects the first and second restraining ends 142 and 143.

Figure 6A:
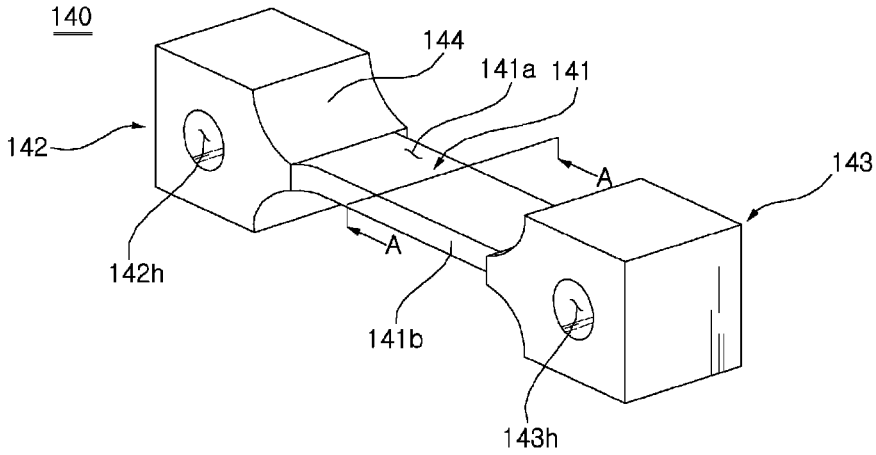
FIGS. 6A, 6B, 6C, and 6D are views illustrating the deformation member of FIG. 5.
Figure 6B:
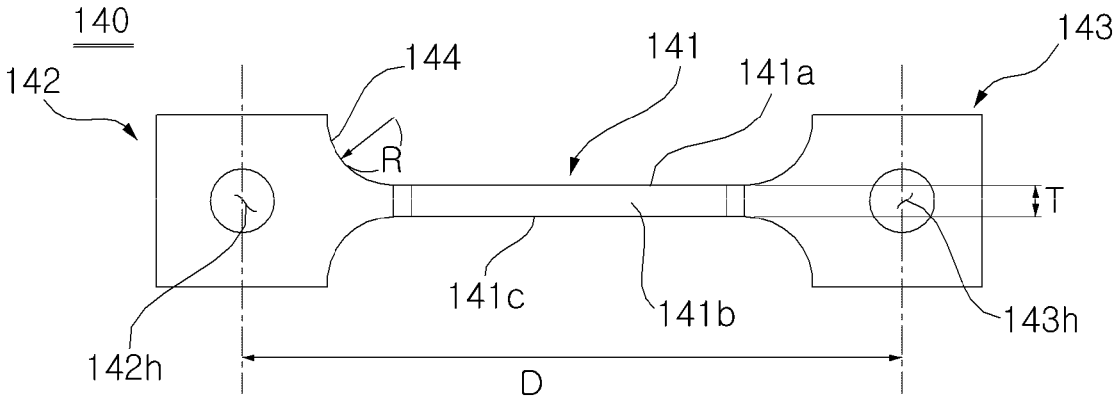
Figure 6C:
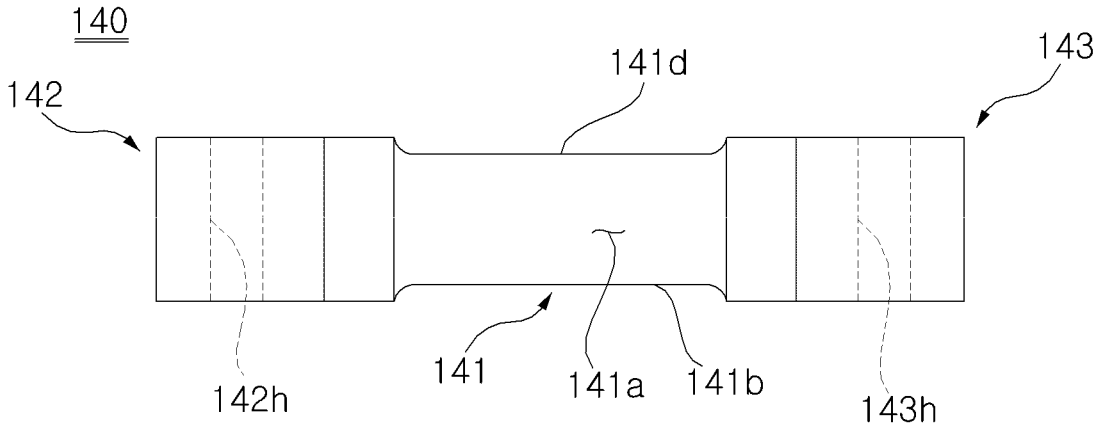
Figure 6D:
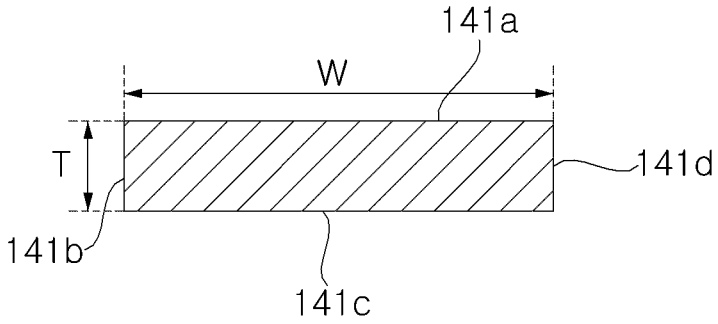

A strain gauge 20 may be attached on the connecting portion 141 to measure the strain of the connecting portion 141 when the connecting portion 141 is tensioned in a direction connecting the first restraining end 142 to the second restraining end 143, i.e., in a direction in which the both ends 31 and 32 of the cut portion of the tub support mount 30 is widened, Referring to FIG. 6D, the connecting portion 141 has a rectangular-shape cross-section taken along line A-A of FIG. 6A. The strain of the connecting portion 141 varies in accordance with a ratio between a long side length W and a short side length T of the rectangular-shape cross-section. It was noted in a test that the strain of the connecting portion 141 can be relatively accurately measured by the strain gauge 20 within a predetermined range of a receivable laundry loads in the drum 3 when the ratio between W and T is about 4:1.

In order to couple the deformation member 140 between both ends 31 and 32 of the cut portion of the tub support mount 30, the first and second restraining ends 142 and 143 are respectively provided with coupling holes 142*h* and 143*h* through which the coupling members 38 and 39 such as the bolts, nuts, and the like pass. Here, the coupling holes 142*h* and 143*h* extend in a direction in parallel with the long side W of the rectangular-shape cross-section of the connecting portion 141.

The strain gauge 20 is attached to the connecting portion 141 of the deformation member 140. At this point, the strain gauge 20 may be attached to surface 141*a* or 141*c* including the long side W of the rectangular-shape cross-section of the connecting portion 141, or surface 141*b* or 141*d* including the short side T of the rectangular-shape cross-section of the connecting portion 141. It was noted through a test that, under the same condition, the strain measured when the strain gauge 20 is attached to the surface 141*b* or 141*d* including the short side T of the rectangular-shape cross-section of the connecting portion 141 is greater than the strain measured when the strain gauge 20 is attached to surface 141*a* or 141*c* including the long side W of the rectangular-shape cross-section of the connecting portion 141.

Figure 7:
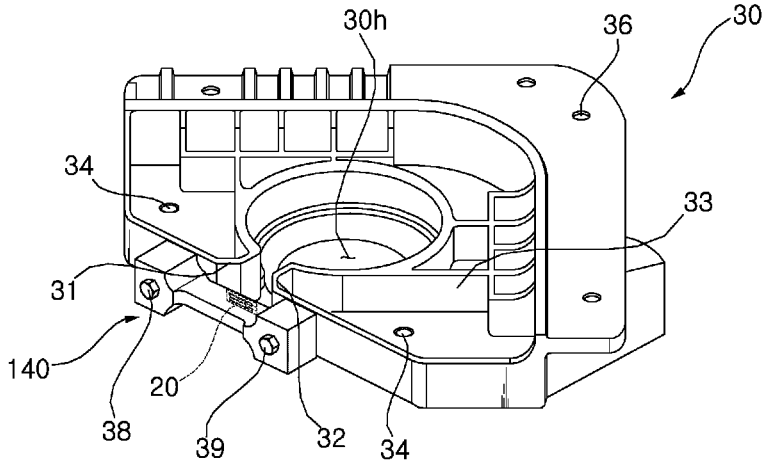
FIG. 7 is a perspective view of a structure where a deformation member and a deformation detecting sensor are installed on a tub support mount on which the suspension of FIG. 3 is mounted according to another embodiment of the invention.

Meanwhile, the strain gauge 20 illustrated in FIG. 5 may be attached on a front surface 141*b* among the surfaces including the short side T of the rectangular-shape cross-section of the connecting portion 141. Here, one (see 141*d* of FIG. 6D) of the two surfaces including the short side T of the rectangular-shape cross-section of the connecting portion 141, on which the strain gauge 20 is attached as shown in FIG. 7, faces the tub support mount 30. Therefore, the surface 141*d* will be referred to as a facing surface. The other surface (see 141*b* of FIG. 6D) on which the strain gauge 20 is attached is formed opposite to the facing surface. The surface 141*b* is relatively more deformed than the facing surface and becomes a surface at which the maximum strain is measured by the strain gauge 20. Therefore, the surface 141*b* will be referred to as a maximum deforming surface.

Referring again to FIGS. 6A and 6D, the connecting portion 141 is formed in a rectangular shape having four side surfaces connecting the first restraining end 142 to the second restraining end 143. Both ends of the side surfaces 141*a* and 141*c* including the long side W of the rectangular-shape cross-section of the connecting portion 141, which is taken along line A-A, are interconnected to the first straining end 142 and second straining end 143, respectively, with a predetermined curvature. To realize this, each of the first and second restraining ends 142 and 143 is provided with a curved surface 144 extending from a portion, at which it meets the connecting portion 141, a curvature of 1/R.

As the both ends of the connecting portion 141 are connected by curved surfaces to the first and second restraining ends 142 and 143, respectively, a crack, which may occur between both ends of the connecting portion 141 and the first or second restraining end 142 or 143 when the connecting portion 141 is tensioned, or fracturing caused by the crack, can be prevented.

FIG. 7 is a perspective view of a structure where a deformation member and a deformation detecting sensor are installed on a tub support mount on which the suspension of FIG. 3 is mounted according to another embodiment of the invention.

Referring to FIG. 7, like the embodiment of FIG. 5, the deformation member 140 of this embodiment is also coupled to the tub support mount 30. However, this embodiment is different from the embodiment of FIG. 5 in that the strain gauge 20 is attached to the facing surface 141*d* of the connecting portion 141.

Because the bending caused when the both ends 31 and 32 of the tub support mount 30 is widened is weaker at the facing surface 141*d* that at a maximum deforming surface 141*b*, the measuring error of the strain gauge 20 by the bending or the permanent deformation can be reduced.

Figure 8A:
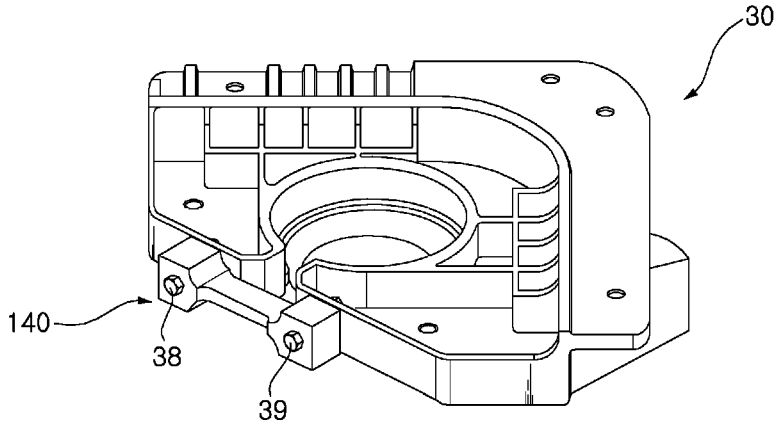
FIGS. 8A and 8B illustrate a coupling structure of a tub support mount on which the suspension of FIG. 3 is mounted and a deformation member according to an embodiment of the invention.
Figure 8B:
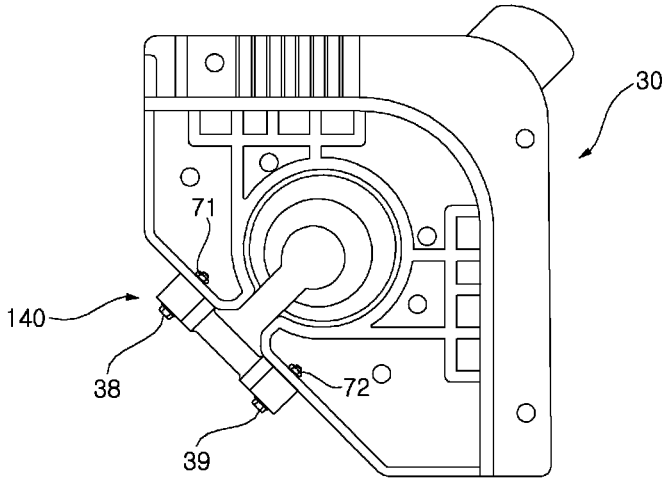

FIGS. 8A and 8B illustrate a coupling structure of a tub support mount on which the suspension of FIG. 3 is mounted and the deformation member according to an embodiment of the invention.

Referring to FIGS. 8A and 8B, coupling members 38 and 39 such as screws, bolts, and the like penetrate coupling holes 142*h* and 143*h* of the respectively first and second restraining ends 142 and 143 and further penetrate the respective both ends 31 and 32 of the cut portion of the tub support mount 30, after which the nuts 71 and 72 are coupled to the coupling members 38 and 39, thereby fixing the deformation member 140. Here, the deformation member 140 contacts the outer circumferential surface of the tub support mount 30 and the nuts 71 and 72 contact the inner-circumferential surface of the tub support mount 30.

Figure 9A:
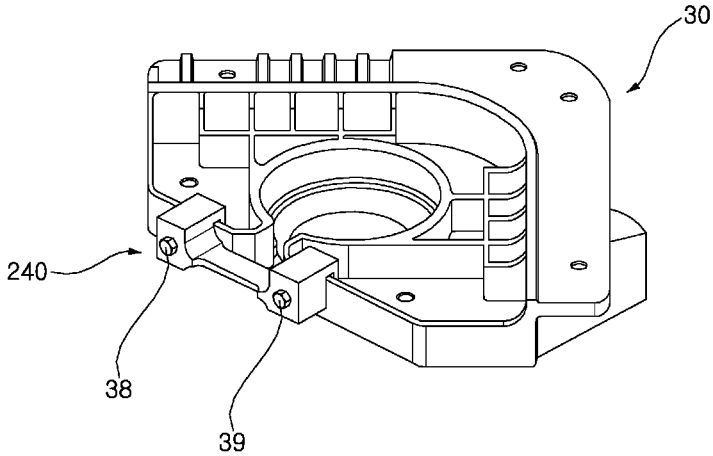
FIGS. 9A and 9B illustrate a coupling structure of a tub support mount on which the suspension of FIG. 3 is mounted and a deformation member according to another embodiment of the invention.
Figure 9B:
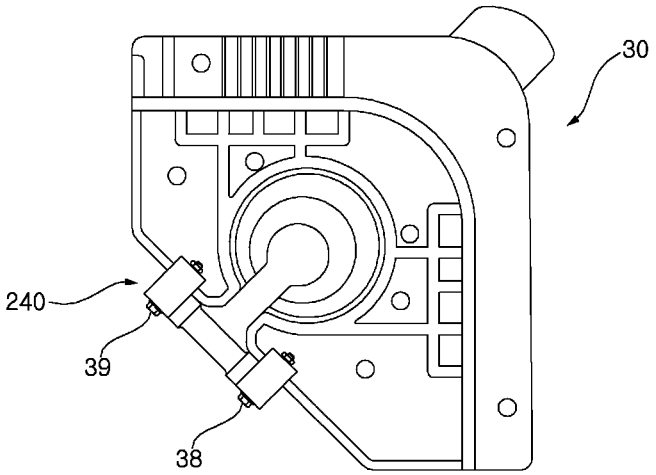
Figure 10A:
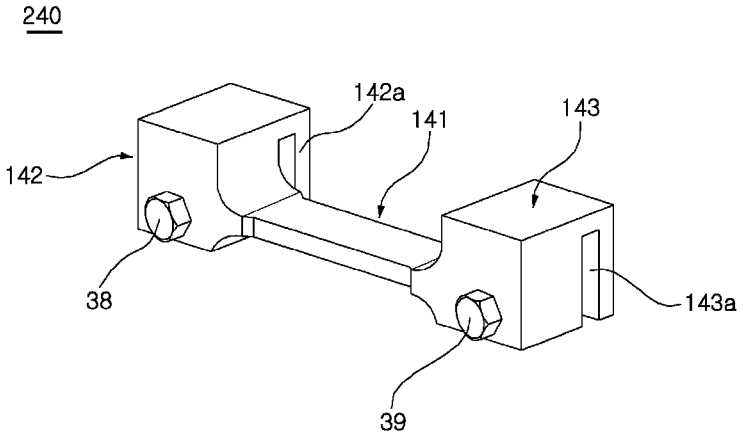
FIGS. 10A and 10B are views of the deformation member of FIGS. 9A and 9B.
Figure 10B:
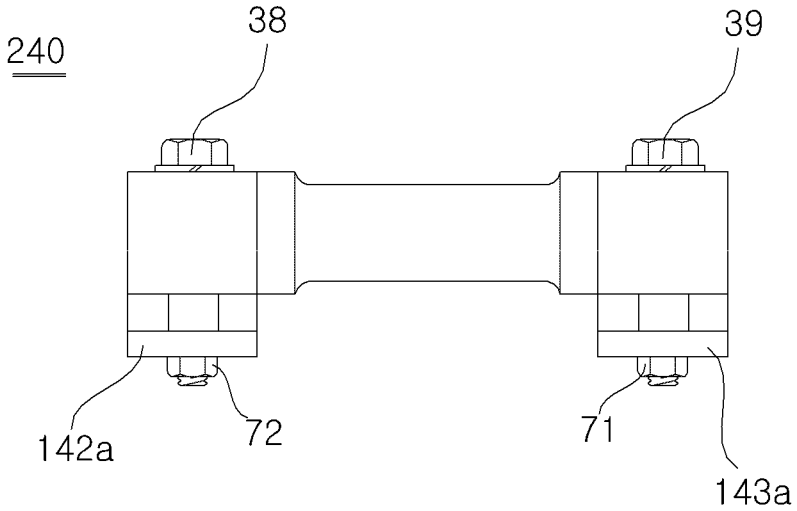

FIGS. 9A and 9B illustrate a coupling structure of a tub support mount on which the suspension of FIG. 3 is mounted and the deformation member according to another embodiment of the invention. FIGS. 10A and 10B are views of the deformation member of FIGS. 9A and 9B.

Referring to FIGS. 9A, 9B, 10A, and 10B, a facing surface of this embodiment includes hook portions 142*a* and 143*a* that are hooked on the tub support mount 30. The hook portions 142*a* and 143*a* are respectively formed on the first and second restraining ends 142 and 143. When the hook portions 142*a* and 143*a* are hooked on the tub support mount 30, the deformation member 240 is temporarily held in its assembled position on the tub support mount 30, after which the coupling members 38 and 39 such as the screws, bolts, and the like pass through the coupling holes (not shown, but similar to 142*h* and 143*h*) of the first and second restraining ends 142 and 143. Thereafter, both ends 31 and 32 of the tub support mount 30 and the hook portions 142*a* and 143*a* are coupled the to the tub support mount 30 via coupling members 38 and 39 and nuts 71 and 72.

Figure 11A:
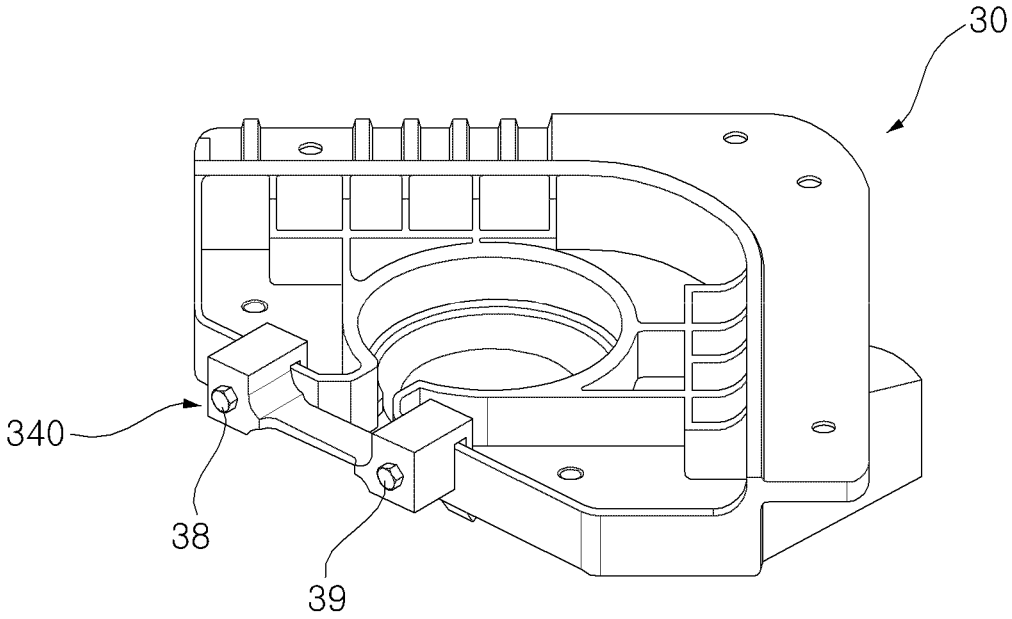
FIGS. 11A and 11B are views illustrating a coupling structure of a tub support mount on which the suspension of FIG. 3 is mounted and a deformation member according to another embodiment of the invention.
Figure 11B:
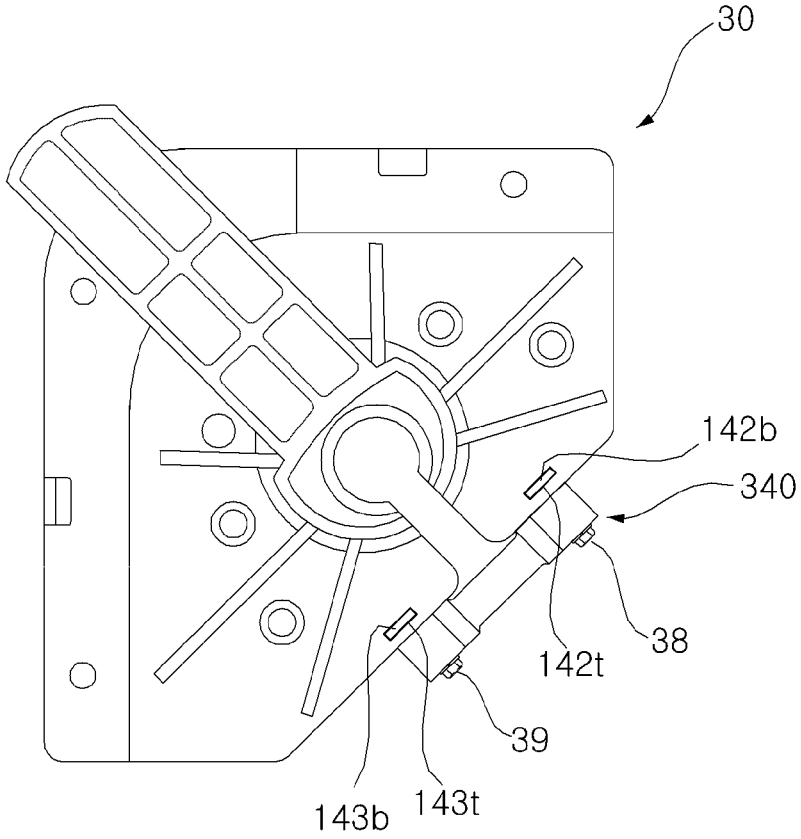
Figure 12A:
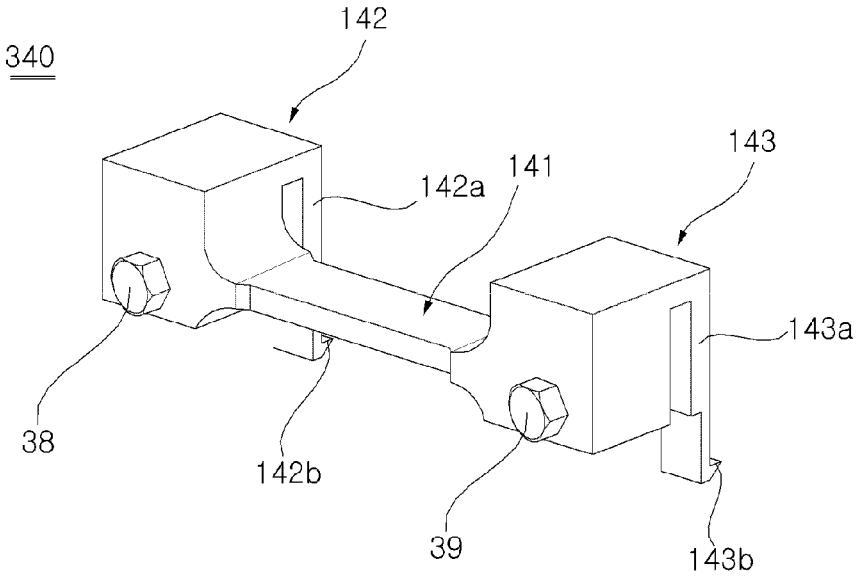
FIGS. 12A and 12B are views of the deformation member of FIGS. 11A and 11B.
Figure 12B:
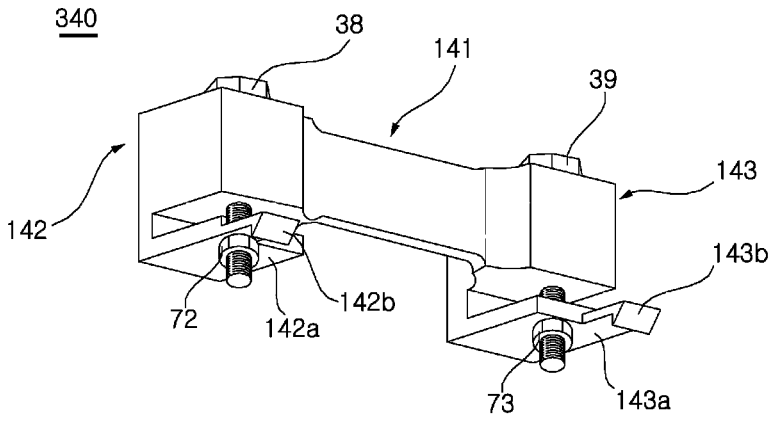

FIGS. 11A and 11B are views illustrating a coupling structure of the tub support mount on which the suspension of FIG. 3 is mounted and the deformation member according to another embodiment of the invention. FIGS. 12A and 12B are views of the deformation member of FIGS. 11A and 11B.

Referring to FIGS. 11A, 11B, 12A, and 12B, a deformation member 340 of this embodiment is different from the deformation member 240 of the foregoing embodiment in that it is further provided with hooks 142*b* and 143*b* formed on end portions of the hook portions 142*a* and 143*a*. Additionally, hook coupling holes 142*t* and 143*t*, to which the hooks 142*b* and 143*b* are coupled, are formed on the tub support mount 30.

When the deformation member 340 is preliminarily assembled on the tub support mount 30, the coupling location of the deformation member 340 can be accurately set as the hooks 142*b* and 143*b* are coupled to the hook coupling holes 142*t* and 143*t*, respectively. After the deformation member 340 is preliminarily assembled on the tub support mount 30, the coupling members 38 and 39 can pass through the coupling holes (not shown, but similar to 142*h* and 143*h*) of the first and second restraining ends 142 and 143. Thereafter, both ends 31 and 32 of the tub support mount 30 and the hook portions 142*a* and 143*a* are coupled the to the tub support mount 30 via coupling members 38 and 39 and nuts 71 and 72.

Figure 13:
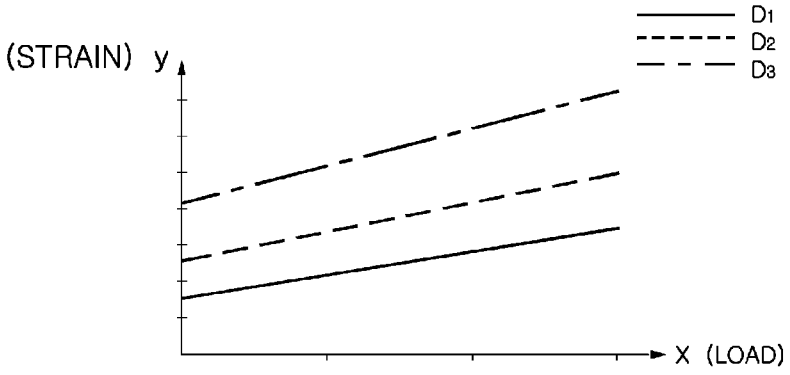
FIG. 13 is a graph illustrating a strain in accordance with a load applied to deformation members having different lengths to compare degrees of deformation according to the length of the deformation member of FIGS. 6A, 6B, 6C, and 6D.

FIG. 13 is a graph illustrating strain in accordance with a load applied to deformation members having different lengths to compare degrees of deformation according to the length of the deformation member of FIGS. 6A, 6B, 6C, and 6D.

The graph of FIG. 13 illustrates a value measured by the strain gauge 20, which varies in accordance with a load in the case where a distance D between centers of the coupling holes 142*h* and 143*h* of FIG. 6*b* is respectively D1, D2, and D3 (D1>D2>D3). This graph shows that the value of strain measured by the strain gauge 20 increases as the distance D between the centers of the coupling holes 142*h* and 143*h* is reduced.

Figure 14:
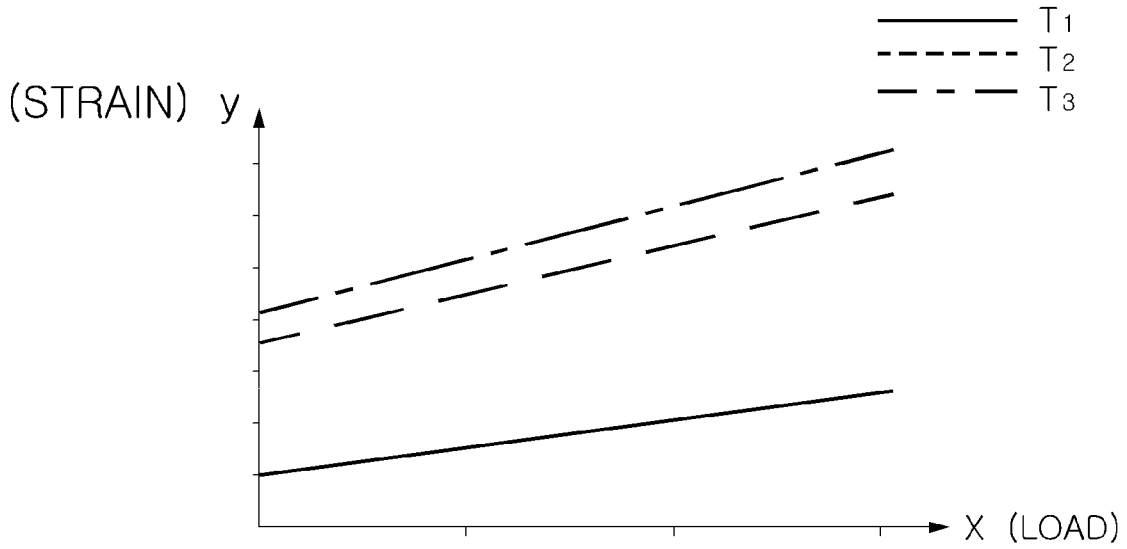
FIG. 14 is a graph illustrating a strain in accordance with a load applied to deformation members having different thicknesses to compare degrees of deformation according to the thickness of the deformation member of FIGS. 6A, 6B, 6C, and 6D.
Figure 15:
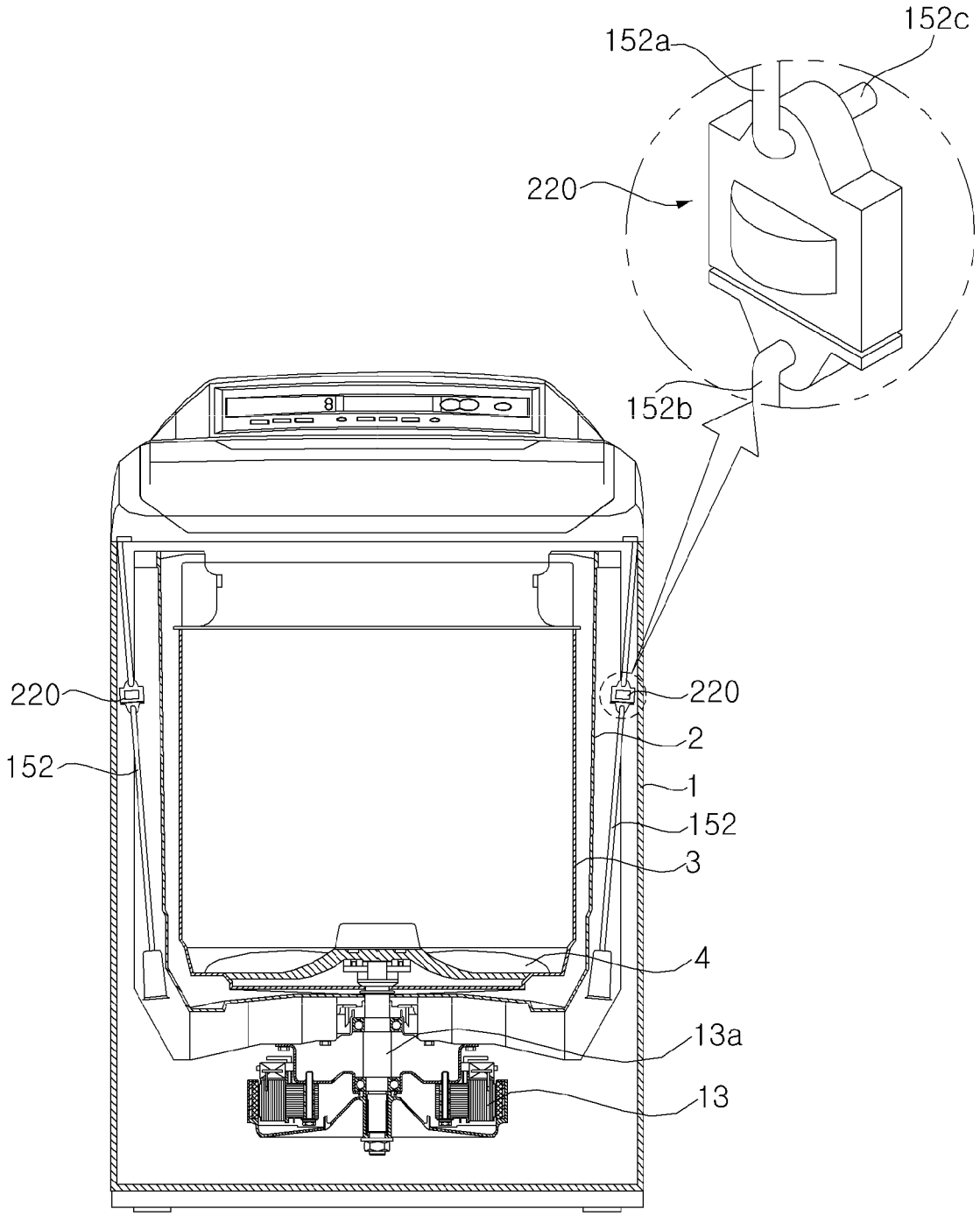
FIG. 15 PRIOR ART
FIG. 15 is a schematic view of a prior art washing machine.

FIG. 14 is a graph illustrating a strain in accordance with a load applied to deformation members having different thicknesses to compare degrees of deformation according to the thickness of the deformation member of FIGS. 6A, 6B, 6C, and 6D.

The graph of FIG. 14 illustrates a value measured by the strain gauge 20, which varies in accordance with a load in the case where a thickness T of the connecting portion 141 is respectively T1, T2, and T3 (T1>T2>T3). This graph shows that the value of strain measured by the strain gauge 20 increases as the thickness of the connecting portion 141 is reduced.

As can be noted from the graphs of FIGS. 13 and 14, because the strain measured is increased as the length and thickness of the connecting member 141 are reduced, the laundry load can be accurately measured even when the laundry load in the drum 3 is relatively small. However, because a ratio of the length and thickness of the connecting portion 141 is closely related with the tensile strength of the connecting portion 141, the connecting portion 141 should be designed to have sufficient tensile strength considering the volume of the washing machine. It was noted through a test that the laundry load of 1-15 kg is accurately measured in 1 kg unit without an excessive effect on durability when the ratio of the length and thickness of the connecting portion 141 is 10:1 to 15:1.

Meanwhile, a controller 11 (see FIG. 2) calculates the laundry load in accordance with the strain measured by the strain gauge 20 and controls, based on the calculated laundry load, an amount of wash water supplied by the water supply unit 12, a driving pattern of the driving unit 13, and operational time of the drain unit 14.

Meanwhile, the washing machine described with reference to FIG. 1 to FIG. 14 according to embodiments of the invention is effective in that the accuracy of laundry load detection is improved compared with the conventional indirect laundry load measuring method that detects the laundry load by rotating the pulsator.

In addition, the washing machine described with reference to FIG. 1 to FIG. 14 according to embodiments of the invention is further effective in that the laundry load can be accurately measured regardless whether the laundry is tangled in the drum or not.

Furthermore, the washing machine described with reference to FIG. 1 to FIG. 14 according to embodiments of the invention is further effective in that the laundry load detection accuracy can be improved by detecting a degree of deformation of a portion where the load applied from the tub is concentrated.

Additionally, the washing machine described with reference to FIG. 1 to FIG. 14 according to embodiments of the invention still further effective in that the laundry load can be accurately detected even when the laundry is wet.

Figure 16:
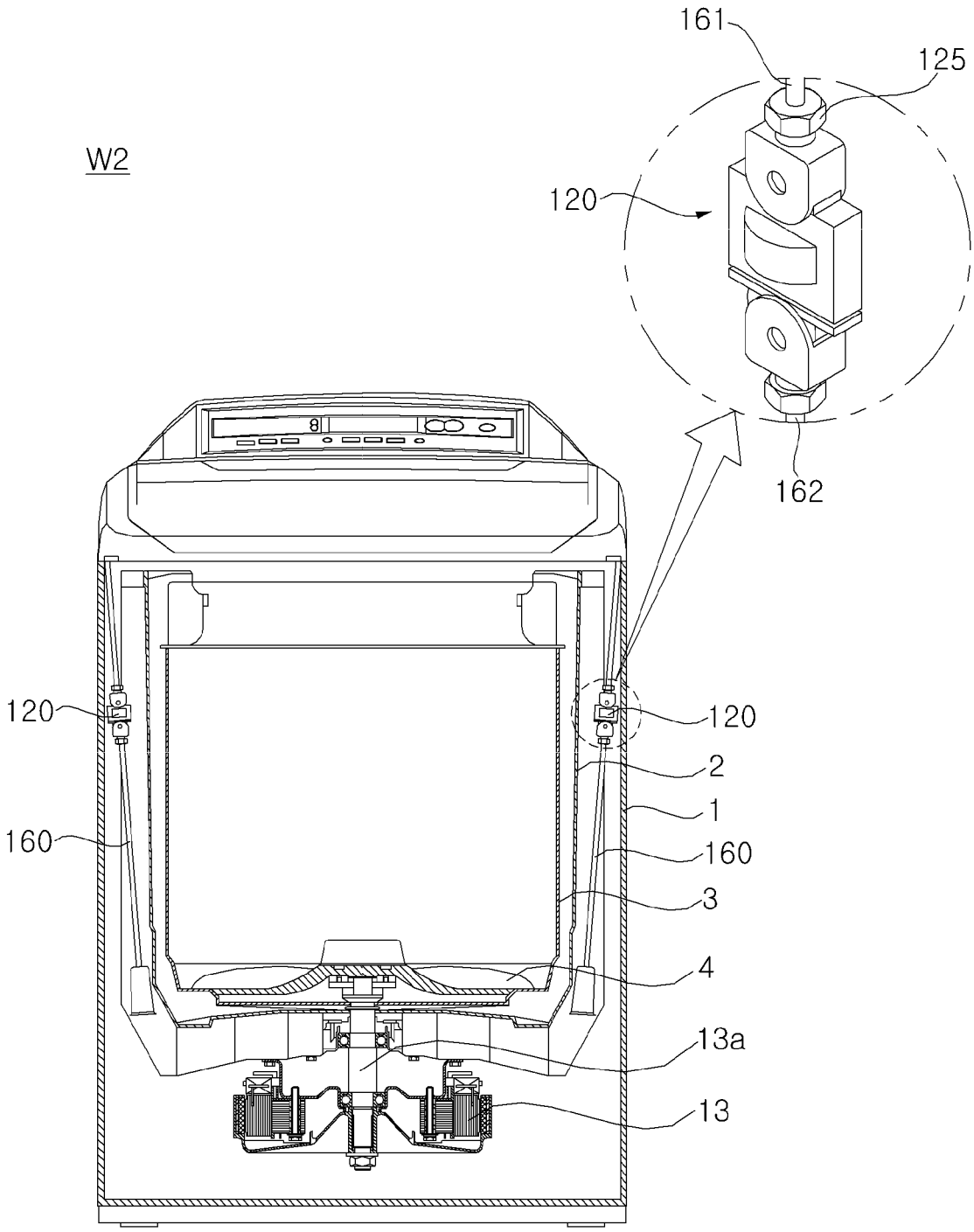
FIG. 16 is a schematic view of a washing machine with a weight detecting sensor according to another embodiment of the invention.

FIG. 16 is a schematic view of a washing machine W2 with a weight detecting sensor 120 according to another embodiment of the invention. Referring to FIG. 16, a washing machine W2 of this embodiment includes a casing 1, a tub 2, a drum 3, and a pulsator 4. The washing machine further includes at least two supporting members 160 that are connected between the casing 1 and the tub 2 to suspend the tub 2 and weight detecting sensors 120 that are provided on the respective supporting members 160 to detect a weight of the laundry loaded in the drum 3. The supporting member 160 is divided into upper and lower bars 161 and 162, and the weight detecting sensor 120 is coupled between the upper and lower bars 161 and 162 by a nut type adaptor 125. The nut type adaptor 125 has a supporting member coupling portion 125*b* and a sensor coupling portion 125*a* that are provided with respective screw threads having different directions (see FIG. 18).

Referring to FIG. 16, the washing machine W2 includes a casing 1 defining an appearance of the washing machine, a tub 2 disposed in the casing 1, and a drum 3 that is rotatably provided in the tub 2. A pulsator 4 is provided under the drum 3. The drum 3 and the pulsator 4 are connected to and driven by a vertical washing shaft 13*a* connected to a driving unit 13.

The casing 1 is formed in a rectangular parallelepiped box shape and provided with a door through which the laundry is loaded and unloaded. The tub 2 is formed in a cylindrical shape having an opened top and suspended in the casing 1 by a supporting member 160.

The supporting member 160 may be provided with a weight detecting sensor 120 that can detect weight using tensile force. A load cell may be used as the weight detecting sensor 120. Referring to an enlarged circle of FIG. 16, the supporting member 160 is divided into upper and lower bars 161 and 162 and the weight detecting sensor 120 is mounted between the upper and lower bars 161 and 162. The weight detecting sensor 120 may be mounted on an upper portion of the supporting member 160. That is, the weight detecting sensor 120 may be located above a horizontal centerline of the supporting member 160. An adapter 125 may couple the upper and lower bars 161 and 162 of the supporting member 160 to the weight detecting sensor 120.

Figure 17:
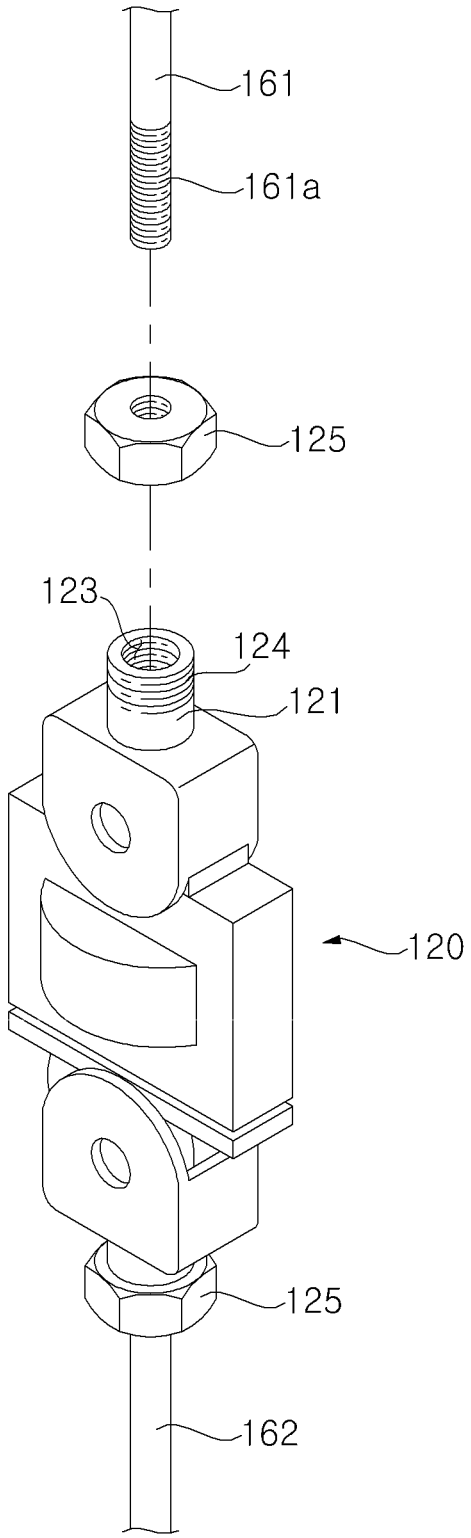
FIG. 17 is an exploded perspective view of the weight detecting sensor of FIG. 16 in accordance with an embodiment of the invention.
Figure 18:
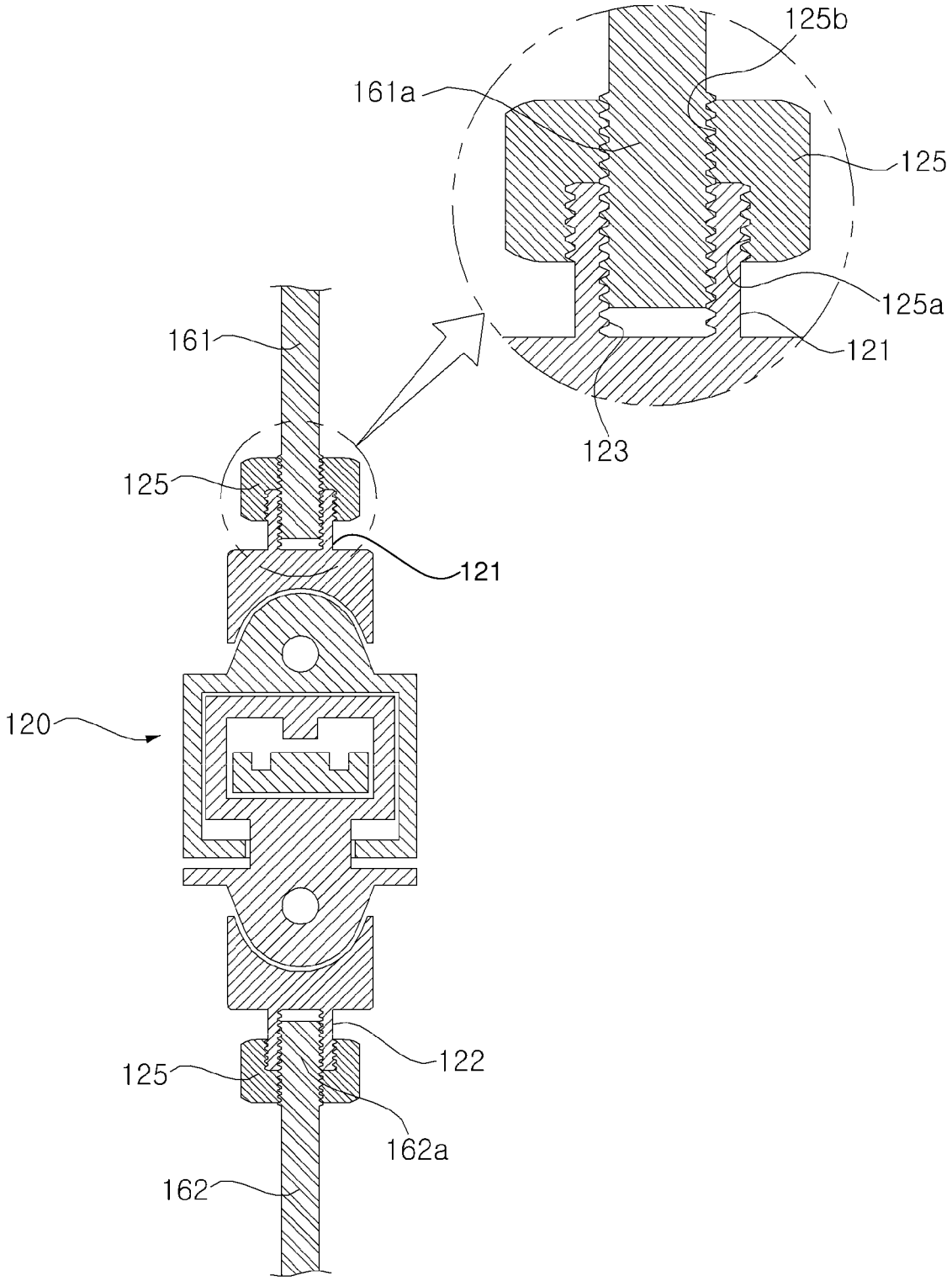
FIG. 18 is a cross-sectional view of the weight detecting sensor of FIG. 16 in accordance with an embodiment of the invention.

The coupling of the weight detecting sensor 120 to the supporting member 160 is illustrated in FIGS. 17 and 18 in more detail. Referring to FIGS. 17 and 18, the adaptor 125 may be a nut type auxiliary coupling member. Adapters 125 may be provided to couple the upper bar 161 to the upper portion of the weight detecting sensor 120 and/or to couple the lower bar 162 to the lower portion of the weight detecting sensor 120.

The inside of the adaptor 125 is divided into two different portions. That is, the adaptor 125 is divided into the supporting member coupling portion 125*b* and the sensor coupling portion 125*a*. Here, the supporting member coupling portion 125*b* and the sensor coupling portion 125*a* have respective screw threads having different thread directions.

For example, the supporting member coupling portion 125*b* may be formed with a right-hand screw thread when the sensor coupling portion 125*a* is formed with a left-hand screw thread. Alternatively, the supporting member coupling portion 125*b* may be formed with the left-hand screw thread when the sensor coupling portion 125*a* is formed with the right-hand screw thread.

The above-described structure is advantageous in that a user can easily couple either supporting member upper or lower bar 161, 162 to the weight detecting sensor 120 using an adaptor 125. In addition, because the supporting member coupling portion 125*b* and the sensor coupling portion 125*a* are formed with the respective screw threads having opposite thread directions, the coupling of the weight detecting sensor 120 to the supporting member 160 is not released (due to the opposite thread directions) even when the supporting member 160 rotates due to a rotation of the drum 3.

The end portions of the upper and lower bars 161, 162 may be threaded. Hereinafter, the threaded end portions of the upper and lower bars 161 and 162 are referred to as threaded ends 161*a* and 162*a*, respectively.

The weight detecting sensor 120 may have an upper coupling structure 121 and a lower coupling structure 122 protruding therefrom. The upper coupling structure 121 may have an outer threaded portion 124, to be received by the sensor coupling portion 125*a* of an adapter 125. The upper coupling structure 121 may also have a threaded interior portion 123, to receive a portion of the upper bar 161 that extends into the interior threaded portion 123 when the upper bar 161 is coupled to the weight detecting sensor 120 by the adapter 125.

An outer diameter of the threaded end 161*a* may be different from the outer diameter of the outer threaded portion 124 of the weight detecting sensor 120. In the adaptor 125, an inner diameter of the suspension coupling portion 125*b* may be different from that of the sensor coupling portion 125*a*.

For example, as shown in FIG. 18, the outer diameter of the upper coupling structure 121 may be greater than that of threaded end of the upper bar 161*a*. In the adaptor 125, the inner diameter of the sensor coupling portion 125*a* may be greater than that of the supporting member coupling portion 125*b*.

By this structure, a portion of the threaded end 161*a* of the upper bar 161 may be further coupled to the threaded inner diameter 123 of the upper coupling structure 121. In this case, the portion of the threaded end 161*a* of the upper bar 161 that protrudes into the threaded inner diameter 123 of the upper coupling structure 121 may be provided with a screw thread having a same screw thread direction as the portion of the upper bar 161*a* that is coupled to the adaptor 125.

According to this structure, because both a portion of the upper bar 161 and the adaptor 125 are directly screw-coupled to the weight detecting sensor 120 (via upper coupling structure 121), the coupling can be more stably maintained.

The above features of the upper coupling structure 121, adapter 125, and upper bar 161 are also applicable to the same or similar features of the lower coupling structure 122, adapter 125, and lower bar 162.

In addition, even when the supporting member rotates in a direction by the rotation of the drum, the coupling by the adaptor 125 is not released. In the example of FIG. 18, when the weight detecting sensor 120 rotates in a right-hand direction and the threaded end portion 161*a* of the upper bar 161, which is coupled to both the adapter 125 and the interior threaded portion 123 of the upper coupling structure 121, is formed with the right-hand screw thread, the coupling of the weight detecting sensor 120 and the upper bar 161 will be more secured. Further, if the weight detecting sensor 120 rotates in a left-hand direction, the coupling of the adaptor 125 and the weight detecting sensor 120 will be made tighter by the left-hand screw thread.

As indicated above, an adaptor 125 may be applied to couple the upper bar 161 to the weight detecting sensor 120, to couple the lower bar 162 and the weight detecting sensor 120, or (with two adapters 125) to couple the upper and lower bars 161 and 162 to the weight detecting sensor 120.

According to the embodiment, the supporting member can be easily coupled to the weight detecting sensor 120 by the adaptor 125.

In addition, because the screw threads having different screw directions are formed on the adaptor 125, the coupling of the supporting member 160 and the weight detecting sensor 120 can be stably maintained even when vibration is transferred to the coupling portions by the rotation of the drum 3.

Further, because the screw threads having different screw directions are formed on the adaptor 125, the coupling of the supporting member 160 and the weight detecting sensor 120 can be stably maintained even when the supporting member 160 rotates by the rotation of the drum 3.

Embodiments of control methods that will be described hereinafter have features that the laundry load or degree of unbalance are detected on the basis of a value that varies in accordance with a vertical load that is applied from the tub according to the laundry load. These control methods can be applied to any of the embodiments of the washing machines made with reference to FIGS. 1 to 14 and embodiments of the washing machine described with reference to FIGS. 16 to 18 within the spirit and scope of the principles of the disclosure. Accordingly, it should be understood that control methods that will be described below are based on a detection value of a deformation detecting unit as embodied in the washing machine W1 and on a detection value of a weight detecting sensor as embodied in the washing machine W2.

Figure 19:
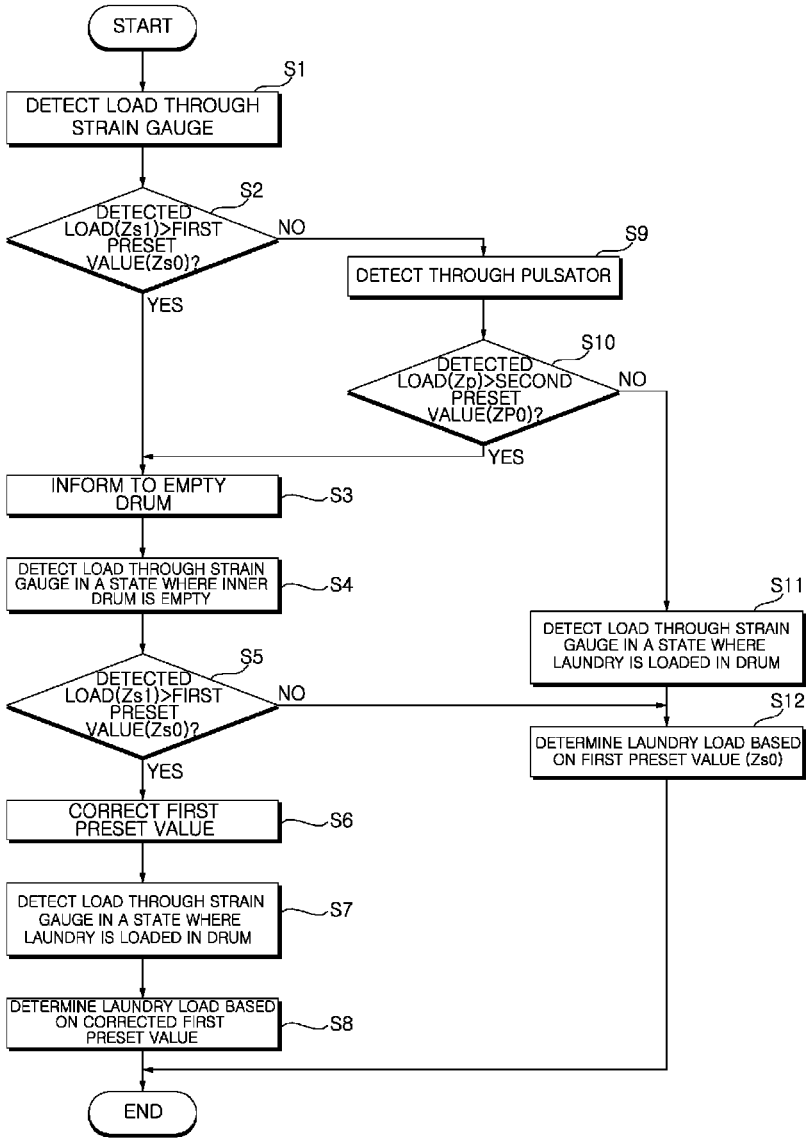
FIG. 19 is a flowchart illustrating a method of controlling a washing machine according to an embodiment of the invention.

FIG. 19 is a flowchart illustrating a method of controlling a washing machine according to an embodiment of the invention. Referring to FIG. 19, the washing machine of the invention goes through a process for detecting load in a state where the laundry is loaded in the drum during washing, rinsing, or spinning. Based on the load detected, the washing machine treats the laundry by applying preset washing pattern, rinsing pattern, or spinning pattern. Although it will be described hereinafter that Step S1 is performed before washing, the invention is not limited to this. That is, Step S1 may be performed before rinsing or spinning.

Step S1 is different from a case where the laundry load is detected during the washing operation of the washing machine. That is, Step S1 is for detecting the laundry load before the washing is performed. Accordingly, according to a typical operation order in which, in a state where the drum 3 is empty, a user turns on electric power and loads the laundry into the drum 3, and the washing is performed, Step S1 is a process for detecting the load in a state where the drum 3 is empty before the laundry is loaded after the power is turned on. Therefore, Step S1 may be performed immediately after the power is turned on.

When the user turns on the power in a state where a predetermined amount of laundry is loaded in the drum 3 in advance and the wash cycle is performed after additional laundry is loaded into the drum 3, Step S1 is performed in a state where only the predetermined amount of laundry is loaded after the power is turned on before the additional laundry is loaded.

In a load detection process that is performed during the washing operation of the washing machine, the laundry load loaded in the drum 3 is determined by comparing a value measured by the strain gauge 20 (or weight detecting sensor 120) with a reference value. The reference value is preset to reflect an empty state of the drum 3. For example, the reference value may be a value measured by the strain gauge 20 in a test mode without any laundry loaded and before the washing machine is released from a factory.

Because a load is continuously applied from the tub 2 to the tub support mount 30, fatigue of the tub support mount 30 is increased as time goes by after the washing machine is installed. The increase of the fatigue causes an aging effect. Therefore, a value measured by the strain gauge in an empty state of the drum 3 of an aged washing machine may be different from the reference value obtained before the washing machine was released from the factory. Therefore, there is a need to correct the reference value frequently.

The correction of the reference value is performed according to a value measured by the strain gauge 20 in an empty state of the drum 3. Therefore, in this embodiment of the invention, it is first determined if the drum 3 is empty. If the laundry is loaded in the drum 3, this state is informed to the user so that the user can empty the drum.

Step S2 is for determining if the drum 3 is empty. A load Zs1 detected in Step S1 is compared with a first preset value Zs0. Here, the first preset value Zs0 is the above-described reference value. The first preset value Zs0 is a preset value reflecting the empty state of the drum 3.

When the load Zs1 is greater than the first preset value Zs0, this means that the laundry is loaded in the drum 3 or the load detected by the strain gauge 20 is greater than the first preset value Zs0 due to the aging of the deformation member 40 although the drum 3 is empty.

When the load Zs1 is greater than the first preset value Zs0, a message for emptying the drum 3 is output (S3). The message may be output in the form of sound by a speaker or a buzzer or visually displayed through a display unit such as a liquid crystal display, a light emitting diode, and the like.

After the above, the load is detected again by the strain gauge 20 (S4). Step S4 may be performed after sufficient time for allowing the user to identify if the laundry is loaded in the drum 3 and unload the laundry passes or performed in accordance with a control signal informing the controller 11 of the empty state of the drum 3.

In Step S5, the load Zs2 detected in Step S4 is compared with the first preset value Zs0. When the load Zs2 is greater than the first preset value Zs0, it is regarded that the load measured by the strain gauge 20 is greater than the first preset value Zs0 even when the drum 3 is empty. Therefore, it can be regarded that the deformation member 40 is aged. Accordingly, the first preset value is corrected to the value Zs2 (S6).

After the above, the user loads the laundry into the drum 3 and the washing machine operates to wash the laundry, in the course of which the load is detected again by the strain gauge 20 (S7) and the laundry load is determined based on the corrected first preset value (S8). Here, the laundry load is determined by a difference value between the load detected in Step S7 and the corrected first preset value Zs2.

Meanwhile, when Zs1 is equal to or less than Zs0 in Step S2, the load is detected again using the pulsator 4 (S9). When the Zs1 is equal to or less than Zs0, it can be regarded that the deformation member 40 is not aged and thus there is no need to correct the reference value or that an amount of the laundry loaded in the drum 3 is too small and thus the laundry is not detected by the strain gauge 20.

Accordingly, in Step S9, when the laundry load in the drum 3 is small, the pulsator 4 that can more accurately detect the load than the strain gauge 20 so the pulsator 4 is used to measure the load. Because the detection of the load by the strain gauge 20 is done by the deformation of the deformation member 40, the detection accuracy of the strain gauge 20 is deteriorated when the laundry load in the drum 3 is too small. However, when the load is measured using the pulsator 4, the detection accuracy of the load can be more improved than the case where the strain gauge 20 is used because the variation of the rotational property of the pulsator is detected even when the laundry load in the drum 3 is small.

In Step S10, a load Zp detected in Step S9 is compared with a second preset value Zp0. Here, the second preset value Zp0 is a load that is detected as the rotational property of the pulsator 4 varies when the pulsator 4 rotates in a state where the drum 3 is empty.

When the Zp is greater than the Zp0, it is regarded that the laundry is loaded in the drum 3, a message for emptying the drum 3 is output (S3), after which Steps S4 to S8 are carried out.

On the other hand, in step S10, when the Zp is less than or equal to the Zp0, it is regarded that the drum 3 is empty. Therefore, the load is detected by the strain gauge 20 after the laundry is loaded in the drum 3 (S11) and the laundry load is determined in accordance with the detected load. At this point, the laundry load is determined by a difference between the load detected in Step S11 and the first preset value Zs0 (S12).

After the above, in accordance with the laundry load determined in Step S8 or Step S12, an amount of water to be supplied, a washing pattern, a rinsing pattern, a spinning pattern, a drain time, and the like are set, and according to these, the washing machine operates.

Meanwhile, the controller 11 (see FIG. 2) calculates the laundry load in the drum 3 in accordance with the strain measured by the strain gauge 20 and, based on the calculated laundry load, controls the amount of wash water supplied by the water supply unit 12, the driving pattern of the driving unit 13, and the operational time of the drain unit 14.

The washing machine control method according to the embodiment of the invention described with reference to FIG. 19 is effective in that it can be accurately detected whether the laundry is loaded in the drum before the washing is performed.

In addition, the washing machine control method is effective in that the load in the empty state of the drum can be accurately detected.

In addition, the washing machine control method is effective in that the laundry load detection accuracy can be improved.

In addition, the washing machine control method is effective in that the user can identify whether laundry was loaded into the drum before washing is performed.

Figure 20:
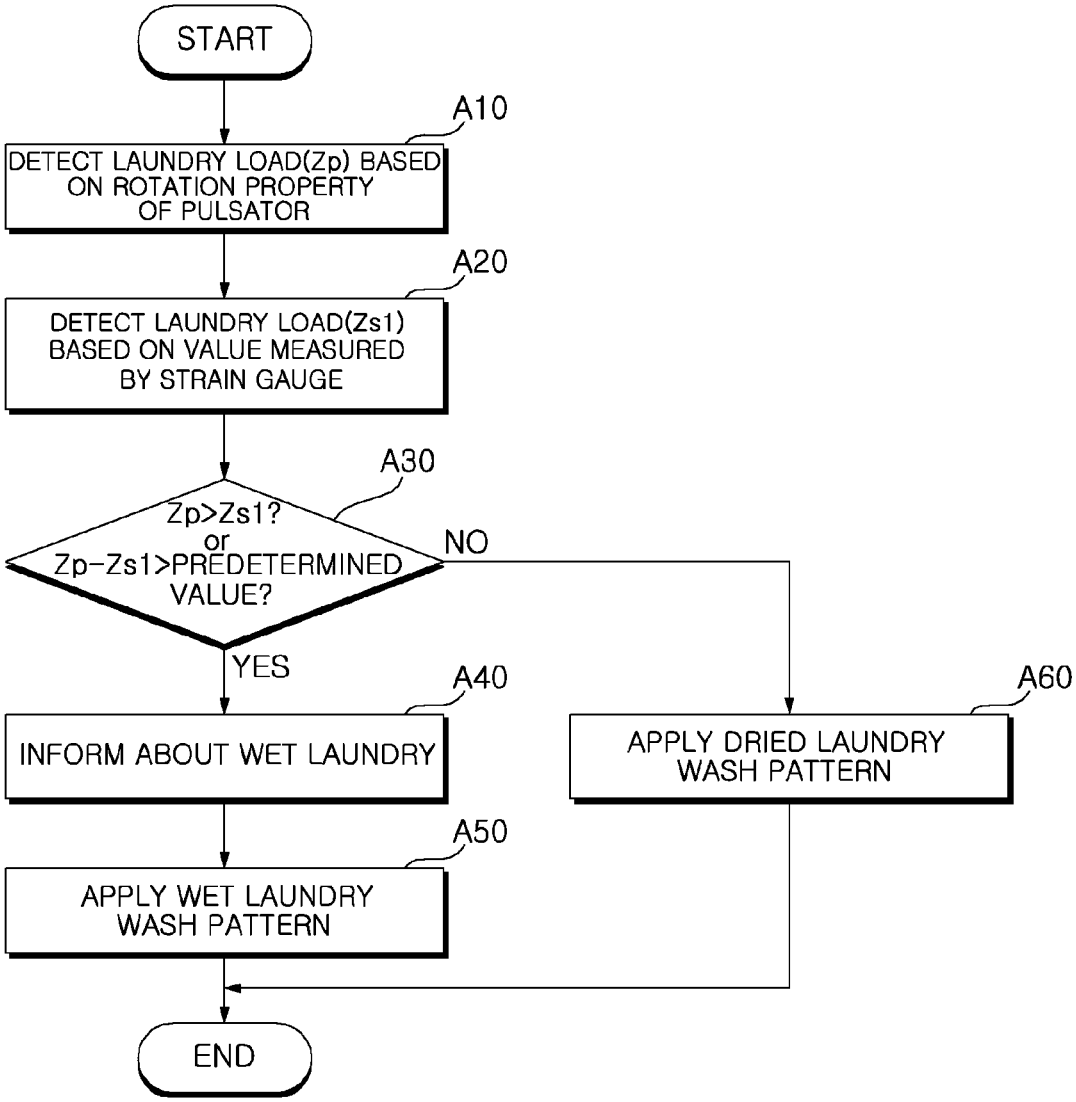
FIG. 20 is a flowchart illustrating a method of controlling a washing machine according to another embodiment of the invention.
Figure 21:
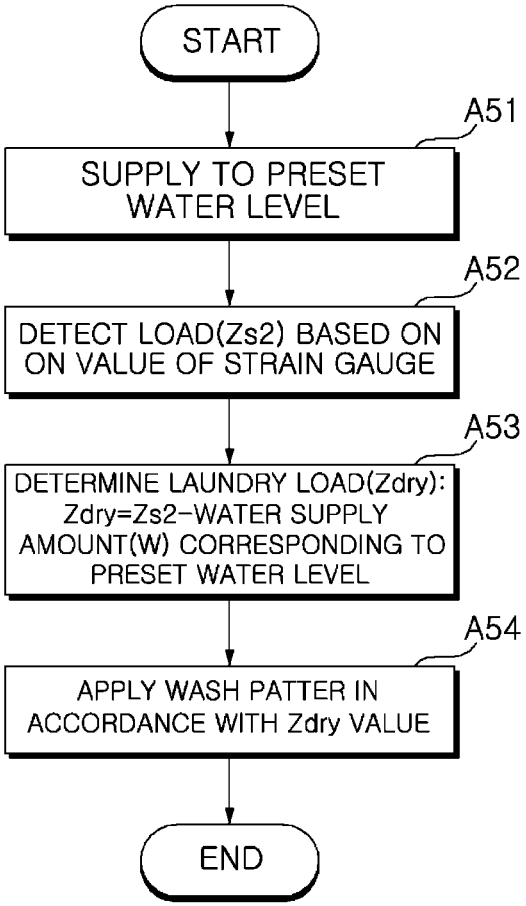
FIG. 21 is a flowchart illustrating an example of Step A50 of FIG. 16 in accordance with an embodiment of the invention.

FIG. 20 is a flowchart illustrating a method of controlling a washing machine according to another embodiment of the invention. FIG. 21 is a flowchart illustrating an example of Step A50 of FIG. 20;

The laundry load detected based on the rotational property of the pulsator 4 and the laundry load detected based on the value measured by the strain gauge 20 are different from each other in a case where dry laundry is loaded in the drum and a case where wet laundry is loaded in the drum. Therefore, a washing machine according to the embodiment of the invention determines whether the laundry loaded in the drum 3 is in a dry state or a wet state.

In more detail, when dry laundry is loaded into the drum 3, the laundry load Zp detected on the basis of the rotational property of the pulsator 4 is substantially same as the laundry load Zs1 detected on the basis of the value measured by the strain gauge 20.

On the other hand, when wet laundry is loaded in the drum 3, the laundry load Zp detected on the basis of the rotational property of the pulsator 4 is greater than the laundry load Zs1 detected on the basis of a property varied in accordance with a vertical load applied by the tub. Laundry load Zs1 may be determined on the basis of the value measured by the strain gauge 20 or weight detecting sensor 120.

That is, for wet laundry, the higher load is applied to the driving unit 13 by the frictional action with the pulsator 4 and the entangling of the wet laundry.

A process for determining if the laundry loaded in the drum 3 is dry laundry or wet laundry will be described hereinafter.

The laundry load is detected while alternately rotating the pulsator 4 in both directions (A10). Here, the laundry load is detected on the basis of the rotational property of the pulsator 4. For example, the typical washing machine can detect the laundry load in accordance with a characteristic where a rotational speed (as measured in RPM) of the driving unit 13 varies differently in accordance with the laundry load as the RPM of the driving unit 13 reaches a predetermined RPM. Alternatively, the typical washing machine can detect the laundry load in accordance with a characteristic where an RPM variation of the driving unit 13 varies in accordance with the laundry load when engaging the brakes on the driving unit 13 while rotating the driving unit 13 rotates at a predetermined RPM. Alternatively, the typical washing machine can calculate the laundry load according to a time taken for the RPM of the driving unit to reach a predetermined RPM or for stopping the driving unit 13 rotating at a predetermined RPM.

Additionally, at Step A20, the laundry load is detected on the basis of a value measured by the strain gauge 20 (or weight detecting sensor 120). The detection of the laundry load by the strain gauge 20 is already described above with reference to FIGS. 1 to 6 and thus the detailed description thereof will be omitted herein.

After the above, the laundry load Zp detected in Step A10 is compared with the laundry load Zs1 detected in Step A20 to determine if the laundry loaded in the drum 3 is dry laundry or wet laundry.

In Step A30, when the Zp is greater than the Zs1, it is determined that the laundry loaded in the drum 3 is wet, and the user is informed that wet laundry is loaded in the drum 3 (A40). Meanwhile, it may also be determined in Step A30 that the laundry loaded in the drum 3 is wet when the difference between the Zp and Zs1 is above a predetermined value. If either case is true, then the method may proceed to step A40. Otherwise, it is determined that the laundry loaded in the drum 3 is dry and the method may proceed to step A60.

In the case where it is determined that wet laundry is loaded into the drum (A30), a message for letting the user know the fact that wet laundry is loaded may be output in the form of sound by a speaker or a buzzer or visually displayed through a display unit such as a liquid crystal display, a light emitting diode, and the like.

After Step A40, the washing machine is operated with a wet laundry washing pattern (A50).

Here, a process for controlling water supply will be described with reference to FIG. 21 as an embodiment of a wet laundry washing pattern. In the washing machine of the embodiment, the water supply amount is differently set in accordance with the laundry load. At this point, the water supply amount may be set in accordance with the dry laundry load.

Steps A52 to A53 are processes for calculating the dry laundry load attained by excluding the amount of water contained in the laundry. First, the water is supplied into the tub 2 to a preset water level (A51). The washing machine of the embodiment is provided with an air chamber (not shown) communicating with the tub 2. As the water level of the tub 2 is gradually increased, it is determined if the water level of the tub 2 reaches the preset water level by detecting a pressure variation in the air chamber, thereby controlling the water supply.

Here, a water supply amount required for the water level in the tub 2 to reach the preset water level is a value known through a test. For example, the water supply amount required for the water level in the tub 2 to reach the preset water level can be measured by supplying the water in a state where a predetermined amount of the dry laundry is loaded in the drum 3. Therefore, the preset water level may be set to be low so that the laundry of the substantially same volume can be soaked regardless of the amount of the laundry loaded in the drum 3. A water level may be detected when the water level sensor is divided into water level sections and the water supply is controlled until the water level reaches a target water level. The preset water level may be set as a value corresponding to a minimum water level.

When the water level of the tub 2 reaches the preset water level and thus the supply of the water is stopped, a total amount of the wash water in the tub 2 becomes W regardless of whether the laundry loaded in the drum 3 is wet laundry or dry laundry because the water supply amount W consumed for the water level to reach the preset water level is known in advance.

After the water supply is stopped when the water level in the tub 2 reaches the preset water level, the load is detected again by the strain gauge (A52).

After the above, a dry laundry load Zdry is calculated by a difference value between the load Zs2 detected in Step A52 and the water supply amount W (that is substantially same as the wash water amount in the tub 2 at the preset water level) required for reaching the preset water level (A53).

At the above, the washing machine is operated in accordance with a washing pattern set in accordance with the dry laundry load Zdry calculated in Step A53. For example, the washing or rinsing may be performed by supplying the water to the target water level corresponding to the dry laundry load calculated in Step A53 or the washing, rinsing, or spinning may be performed by setting the RPM of the pulsator 4 or the drum 3 in accordance with the dry laundry load.

Figure 22:
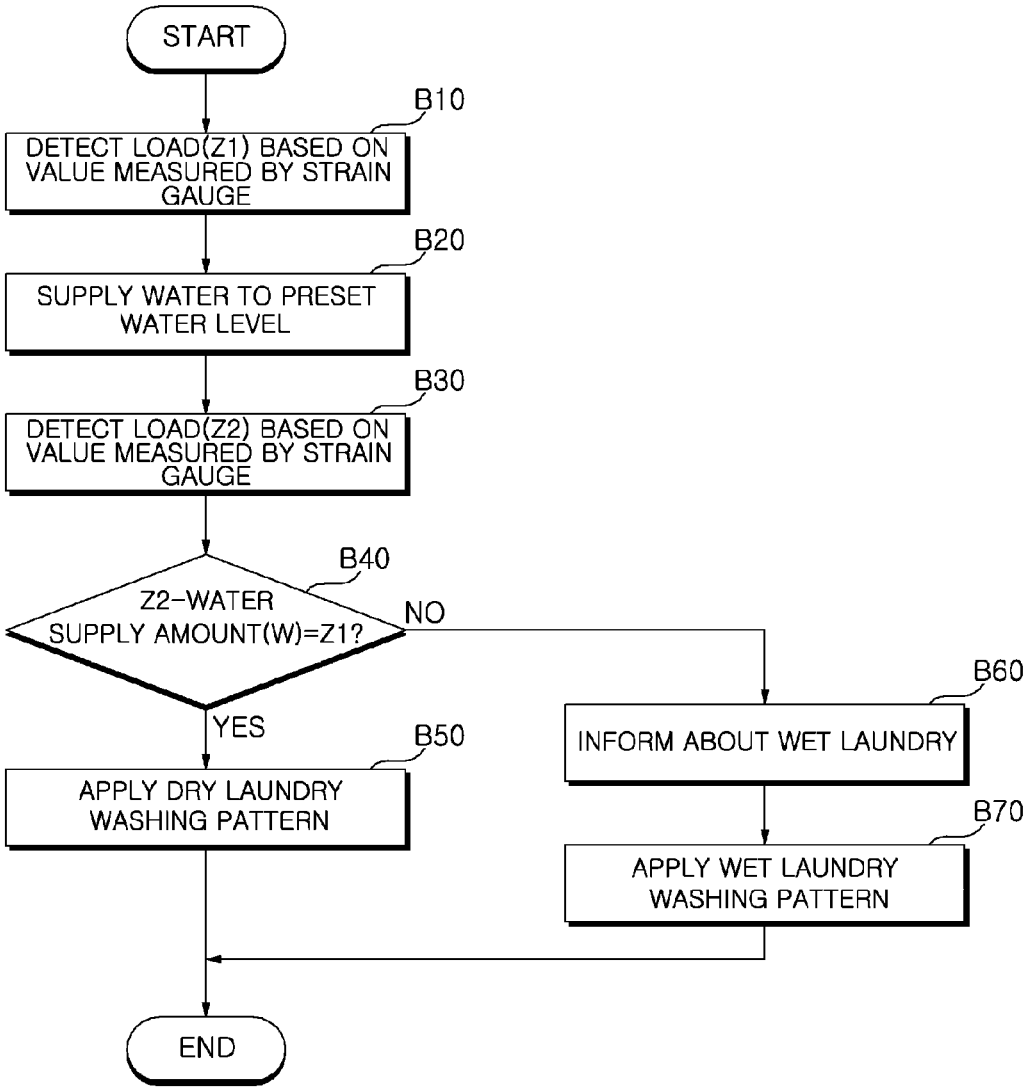
FIG. 22 is a flowchart illustrating a method of controlling a washing machine according to another embodiment of the invention.

FIG. 22 is a flowchart illustrating a method of controlling a washing machine according to another embodiment of the invention. Referring to FIG. 22, only the strain gauge 20 (or weight detecting sensor 120) is used to determine whether the laundry loaded in the drum 3 is wet laundry or dry laundry. Hereinafter, although it is described that the laundry load is determined in accordance with the value detected by the strain gauge 20, the weight detecting sensor 120 may additionally or alternatively be used to detect the laundry load. First, the load is detected on the basis of a value measured by the strain gauge 20 (B10) and the water is supplied into the tub 2 to a preset water level (B20). In a state where the water supply is stopped after the water level of the tub 2 reaches the preset water level, the load is detected again by the strain gauge 20 (B30).

After the above, it is determined if the laundry loaded in the drum 3 is dry laundry or wet laundry based on a difference value between the load Z2 detected in Step B30 and a water supply amount required for reaching the preset water level.

In more detail, when it is determined in Step B40 that Z2-W is substantially equal to Z1, it is determined that dry laundry is loaded in the drum 3 and the washing machine is operated by applying a dry laundry washing pattern (B50). On the other hand, when it is determined in Step B40 that Z2-W is not substantially equal to Z1, it is determined that wet laundry is loaded in the drum 3 and this is informed to the user (B60), after which the washing machine is operated by applying a wet laundry washing pattern (B70).

Here, the wet washing pattern of Step B70 is a washing pattern determined in accordance with the dry laundry load (Z2-W) calculated in Step B40. For example, the washing or rinsing may be performed by supplying the water to the target water level in accordance with the dry laundry load (Z2-W) or the washing, rinsing, or spinning may performed by setting an RPM of the drum 3 or the pulsator 4 in accordance with the dry laundry load.

The washing machine control method according to the embodiments of FIGS. 20 to 22 is effective in that it is accurately detected whether the laundry loaded in the drum is wet laundry or dry laundry.

In addition, optimal washing performance can be attained by differently applying washing patterns in accordance with the determined result of whether the laundry loaded in the drum is dry laundry or wet laundry. Accordingly, water and electric consumption can be reduced and the wear on the laundry can be reduced as compared with a prior art control method where the washing pattern was determined in accordance with the wet laundry load detected in a state where wet laundry was loaded.

Figure 23:
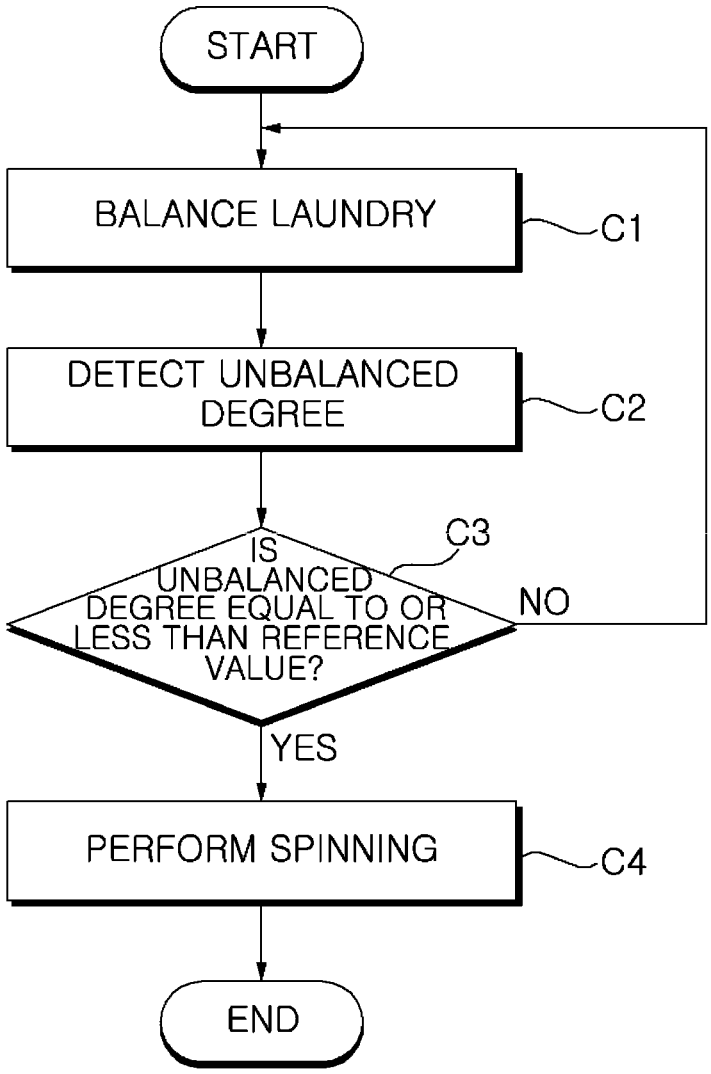
FIG. 23 is a flowchart illustrating a method of controlling a washing machine according to another embodiment of the invention.
Figure 24:
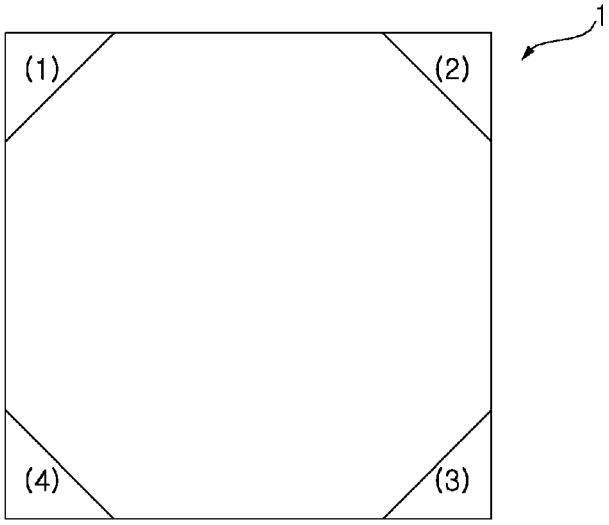
FIG. 24 is a schematic top view of the casing illustrating an installed location of four strain gauges in accordance with an embodiment of the invention.
Figure 25:
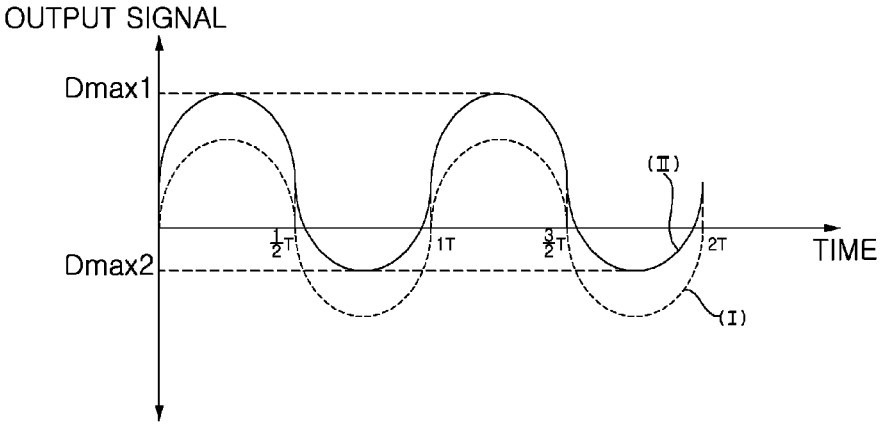
FIG. 25 is a view illustrating a signal wave output from a strain gauge disposed on one of four corners of the casing of the washing machine according to an embodiment of the invention.

FIG. 23 is a flowchart illustrating a method of controlling a washing machine according to another embodiment of the invention. FIG. 24 is a schematic top view of the casing 1, which illustrates locations of strain gauges 20 (of tub support mounts 30) in accordance with an embodiment of the invention. FIG. 25 is a view illustrating a signal wave output from the strain gauge disposed on one of four corners of the casing 1 of the washing machine of the embodiment of the invention.

Hereinafter, although it is described that a degree of unbalance is determined in accordance with the value measured by the strain gauge 20, the weight detecting sensor 120 may be also used to detect the degree of unbalance.

Referring to FIG. 23, a washing machine in accordance with an embodiment of the invention performs balancing so that laundry contained therein can be uniformly dispersed in the drum 3 before performing the spinning at which the drum 3 rotates at a high speed (C1).

In the balancing C1, the pulsator 4 or the drum 3 alternately rotates in both directions so that the laundry in the drum 3 moves. When the drum 3 rotates, the pulsator 4 may rotate together with the drum 3. The pulsator 4 and/or drum 3 may alternately rotate in both directions within one turn cycle.

After the balancing, a degree of unbalance of the laundry is detected while the drum 3 continuously rotates in one direction for a predetermined time (C2). Here, the unbalance degree is a value of a property of matter indicating a degree to which the laundry is uniformly dispersed.

In the washing machine in accordance with an embodiment of the invention, the controller 11 detects the degree of unbalance of the laundry through a variation of strain detected by the strain gauge 20. In more detail, as shown in FIG. 24, the tub support mount 30 is installed on four corners (1), (2), (3), and (4) of the casing. One strain gauge 20 may be disposed to detect the strain of the deformation member 140 provided on one of the tub support mounts 30 mounted on the four corners or a pair of the strain gauges 20 may be used to detect strains of the deformation members 140 provided on the tub support mounts 30 that are disposed in a diagonal direction.

A case where the deformation member 140 and the strain gauge 20 are provided on one of the tub support mounts 30 installed on the four corners and the degree of unbalance of the laundry is detected in accordance with the strain detected by the strain gauge 20 will be first described. That is, a case where the deformation member 140 and the first strain gauge 20 are installed on the corner (1) in FIG. 24 will be described.

In the degree of unbalance detection C2, the strain of the deformation member 140 is detected by the first strain gauge 20. At this point, a signal wave output from the first strain gauge 20 is shown as in FIG. 25.

In FIG. 25, a graph (I) shows a signal wave output from the first strain gauge 20 in a state where the laundry is uniformly dispersed in the drum 3 and a graph (II) indicates a signal wave output from the first strain gauge 20 in a state where the laundry is sided in one direction in the drum 3.

As can be noted from the graph (I), when the laundry is uniformly dispersed in the drum 3, amplitude maximum values having a substantially same value are output every ½ cycle.

On the other hand, in the graph (II), it can be noted that first amplitude maximum values Dmax1 and second amplitude maximum values Dmax2 appear alternately every ½ cycle. In more detail, the amplitude maximum value in a first half cycle section (0 to ½T) is Dmax1 and the amplitude maximum value in a second half cycle section (½ to 1T) becomes the Dmax2. As noted, Dmax2 is less than Dmax1. That is, the signal wave output from the first strain gauge 20 has characteristics where the first and second amplitude maximum values Dmax1 and Dmax2 have a phase difference of $(2N+1)\pi$ from each other, for N=0, 1, 2, 3 . . . .

The reason why the amplitude maximum values having different values are output at every ½ cycle (T) is because the load transferred from the tub 2 to the tub support mount 30 through the suspension 50 varies as the drum 3 rotates. The controller 11 calculates the degree of unbalance of the laundry in accordance with the difference between the amplitude maximum values output at every ½ cycle.

When the degree of unbalance calculated by the controller 11 is relatively high, i.e., when the difference between the Dmax1 and Dmax2 is greater than a reference value, it is regarded that the laundry is not uniformly dispersed in the drum 3. Therefore, the process is returned to Step C1 (FIG. 23) to perform the balancing. On the other hand, when the difference between the Dmax1 and Dmax2 is less than the reference value, it is regarded that the laundry is uniformly dispersed in the drum 3. Therefore, the spinning is performed by rotating the drum 3 at a high RPM (C4).

Meanwhile, in order to more accurately detect the degree of unbalance, the controller 11 calculates difference values between the amplitude maximum value in the first half cycle and the amplitude maximum value in the second half cycle at each cycle as the signal wave output from the first strain gauge 20 appears at more than two cycles and calculates the degree of unbalance in accordance with a mean value of the difference values. For example, among the signal waves output from the first strain gage 20 for the two cycles (hereinafter, 0 to 2T will be exemplarily described), a difference (hereinafter, referred to as "first difference value") between the amplitude maximum value measured for 0 to ½T and the amplitude maximum value measured for ½ to 1T is calculated and a difference (hereinafter, referred to as "second difference value") between the amplitude maximum value measured for 1 to 3/2T and the amplitude maximum value measured for 3/2 to 2T is calculated. The degree of unbalance is attained from the mean value of the first and second difference values.

Alternatively, the controller 11 calculates difference values between the amplitude maximum value in the first half cycle and the amplitude maximum value in the second half cycle at each cycle as the signal wave output from the first strain gauge 20 appears at more than four cycles and calculates the degree of unbalance in accordance with a mean value of the difference values.

Figure 26:
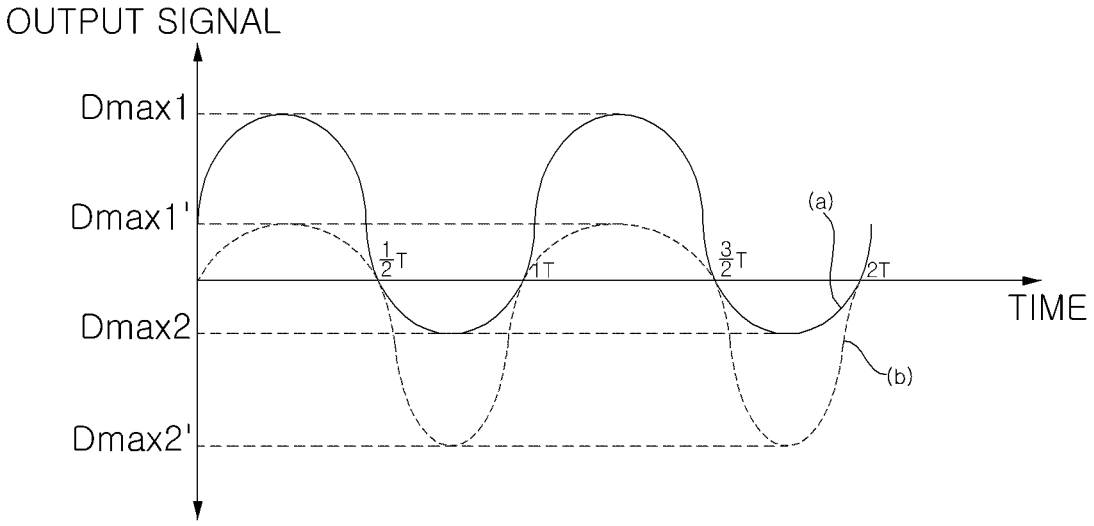
FIG. 26 is a view illustrating a signal wave output from the strain gauges disposed on two diagonal corners of the four corners of the casing of the washing machine according to an embodiment of the invention.

FIG. 26 is a view illustrating a signal wave output from the strain gauges disposed on two diagonal corners of the four corners of the casing of FIG. 24 of a washing machine in accordance with an embodiment of the invention.

Referring to FIG. 26, in order to more accurately detect the degree of unbalance, the washing machine of the invention may use two strain gauges that are diagonally disposed. Hereinafter, a first strain gauge 20 disposed on the location (1) of FIG. 24 and a second strain gauge 20' disposed on the location (3) of FIG. 24 will be exemplarily described. The second strain gauge 20' is substantially same as the first strain gauge 20. The second strain gauge is indicated by reference numeral 20' so that it can be differentiated from the first strain gauge 20.

Describing signal waves output from the first and second strain gauges 20 and 20' in a state where the laundry is uniformly dispersed in the drum 3, an amplitude maximum value of a first signal wave (graph (a) in FIG. 26) output from the first strain gauge 20 in a first half cycle section (0 to ½T) is Dmax1 and an amplitude maximum value of a second signal wave (graph (b) in FIG. 26) output from the second strain gauge 20' is Dmax1'. As can be seen from the graph, Dmax1' is less than the Dmax1.

After a time of ½ cycle passes, an amplitude maximum value of a first signal wave output from the first strain gauge 20 in a second half cycle section (½ to 1T) is Dmax2 (which is less than the Dmax1) and an amplitude maximum value of a second signal wave output from the second strain gauge 20' is Dmax2' (which is greater than the Dmax2).

Here, because the first and second strain gauges 20 and 20' are diagonally disposed, Dmax1 and Dmax2' are substantially the same as each other and Dmax1' and Dmax2 are substantially the same as each other. Accordingly, the first signal wave output from the first strain gauge 20 and the second signal wave output from the second strain gauge 20' have a phase difference of about ½ cycle (T).

The controller 11 can more accurately calculate the degree of unbalance by calculating a mean value of a difference value between the Dmax1 and Dmax2 measured by the first strain gauge 20 and a difference value between the Dmax1' and Dmax2' measured by the second strain gauge 20'. Here, in the signal wave output from the first strain gauge 20, the half cycle where the Dmax1 is detected and the half cycle where the Dmax2 is detected have a phase difference of $(2N+1)\pi$ from each other, for N=0, 1, 2, 3 . . . . In the signal wave output from the second strain gauge 20', the half cycle where the Dmax1' is detected and the half cycle where the Dmax2' is detected have a phase difference of $(2N+1)\pi$ from each other, for N=0, 1, 2, 3 . . . .

Alternatively, the controller 11 calculates different values between the Dmax1 and Dmax2 in each cycle among the signal waves output from the first strain gauge 20 for at least 4 cycles (T) and calculates a mean value M1 of the different values excluding maximum and minimum values. Likewise, the controller 11 calculates different values between the Dmax1 'and Dmax2' in each cycle among the signal waves output from the second strain gauge 20' for at least 4 cycles (T) and calculates a mean value M2 of the different values excluding maximum and minimum values. In addition, the degree of unbalance may be calculated by calculating a mean value ((M1+M2)/2) of the mean values M1 and M2.

Figure 27:
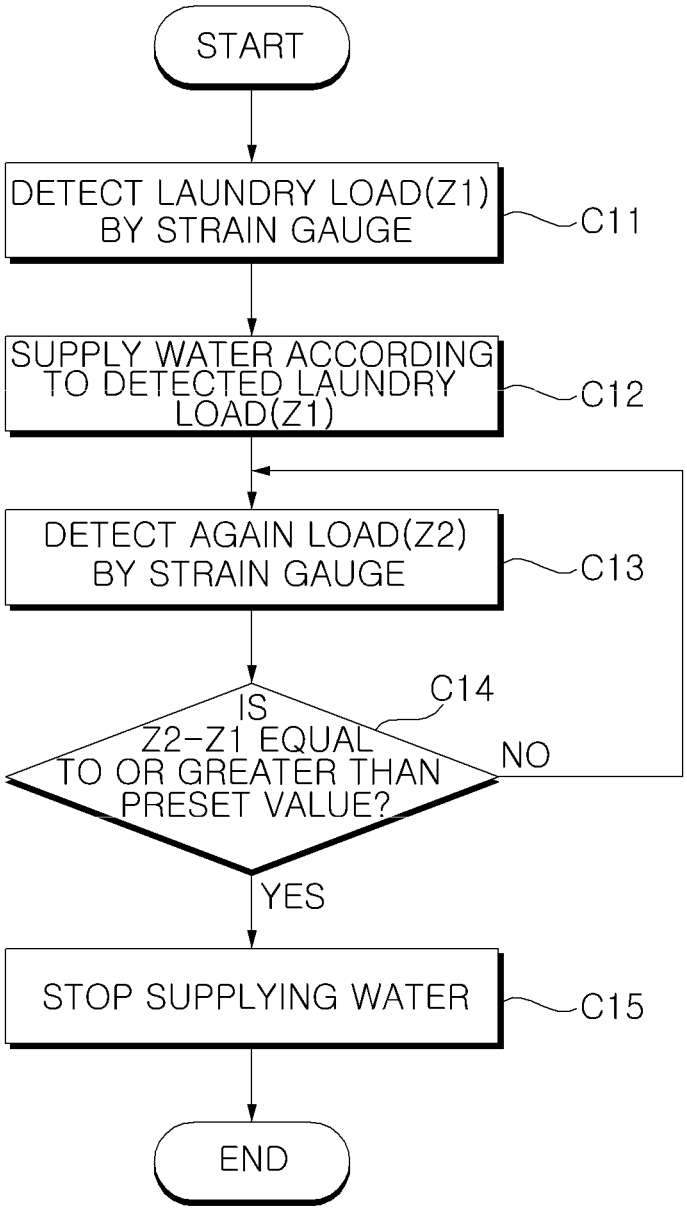
FIG. 27 is a flowchart illustrating a method of controlling a washing machine according to another embodiment of the invention.

FIG. 27 is a flowchart illustrating a washing machine control method according to another embodiment of the invention. Referring to FIG. 27, the washing machine of the embodiment of the invention detects the laundry load through the strain gauge 20 (C11) and supplies the water in accordance with the detected laundry load Z1 (C12). Hereinafter, although it is described that the laundry load is determined in accordance with the value detected by the strain gauge 20, the weight detecting sensor 120 may be also used to detect the laundry load.

In Step C12, a final water supply amount varies in accordance with the load detected in Step C11. As the load detected in Step C11 is increased, the final water supply amount is increased.

In order to determine if the water is supplied as much as the final water supply amount, the load is detected again by the strain gauge 20 during the water supply (C13) and a difference value between the load Z2 detected in Step C13 and the load Z1 detected in Step C11 is compared with a preset value, thereby determining if the water is supplied as much as the final water supply amount (C14).

When it is determined in Step C14 that Z2−Z1 is equal to or greater than the preset value, it is regarded that the water is supplied as much as the final water supply amount and thus the water supply is stopped (C15). If Z2−Z1 is less than the preset value, it is regarded that the water is not supplied as much as the final water supply amount, the process is returned to Step C13 to detect again the load through the strain gauge 20.

In a prior art method using a water level sensor to control the water supply, because the water level is indirectly measured by detecting pressure of the air chamber communicating with a tub, which varies as the water level in the tub increases, the accuracy is deteriorated. A prior art water level measuring method using an opening time control of a water supply valve has a limitation in that the water supply amount varies in accordance with pressure of the water supplied to the water supply valve by an outside source.

The washing machine control method of the embodiment of the invention described herein detects an amount of water supplied into the tub 2 in accordance with variation of the load detected by the strain gauge 20. Therefore, the washing machine control method according to the embodiment disclosed herein can more accurately control the water supply amount by directly detecting the variation of the load according to the increase of the water level as compared with the prior art methods using the water level sensor or opening time control of a water supply valve.

Figure 28:
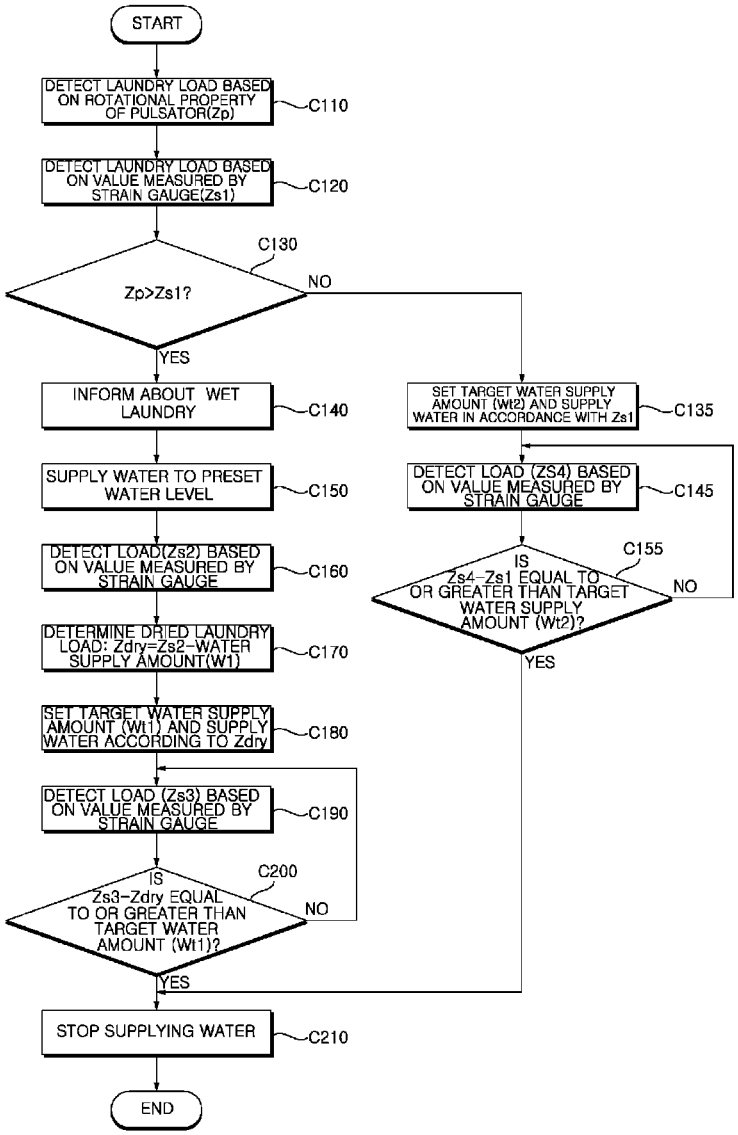
FIG. 28 is a flowchart illustrating a method of controlling a washing machine according to another embodiment of the invention.

FIG. 28 is a method of controlling a washing machine according to another embodiment of the invention. Referring to FIG. 28, the washing machine of this embodiment detects a laundry load while alternately rotating the pulsator in both directions (C110). Here, the laundry load is detected on the basis of the rotational property of the pulsator 4. For example, the typical washing machine can detect the laundry load in accordance with a characteristic where a rotational speed (as measured in RPM) of the driving unit 13 varies differently in accordance with the laundry load as the RPM of the driving unit 13 reaches a predetermined RPM. Alternatively, the typical washing machine can detect the laundry load in accordance with a characteristic where an RPM variation of the driving unit 13 varies in accordance with the laundry load when engaging the brakes on the driving unit 13 while rotating the driving unit 13 rotates at a predetermined RPM. Alternatively, the typical washing can calculate the laundry load according to a time taken for the RPM of the driving unit to reach a predetermined RPM or for stopping the driving unit 13 rotating at a predetermined RPM.

Additionally, at Step C110, the laundry load is detected on the basis of a value measured by the strain gauge 20 (C120). The detection of the laundry load by the strain gauge 20 is already described above and thus the detailed description thereof will be omitted herein.

Step C130 is for comparing the laundry load Zp detected in Step C110 with the laundry load Zs1 detected in Step C120. When the Zp is greater than the Zs1, it is determined that the laundry loaded in the drum 3 is wet, it is informed to the user that wet laundry is loaded in the drum 3 (C140). A message for letting the user know the fact that wet laundry is loaded may be output in the form of sound by a speaker or a buzzer or visually displayed through a display unit such as a liquid crystal display, a light emitting diode, and the like.

The reason why it can be determined in step C130 that the laundry loaded in the drum 3 is in a dry state or a wet state by comparing the Zp with the Zs1 is that the laundry load Zp detected based on the rotational property of the pulsator 4 and the laundry load Zs1 detected based on the value measured by the strain gauge 20 are different from each other in a case where the dry laundry is loaded in the drum and a case where wet laundry is loaded in the drum. In more detail, when dry laundry is loaded in the drum 3, the laundry load Zp detected on the basis of the rotational property of the pulsator 4 is substantially the same as the laundry load Zs1 detected on the basis of the value measured by the strain gauge 20. On the other hand, when wet laundry is loaded in the drum 3, the laundry load Zp detected on the basis of the rotational property of the pulsator 4 is greater than the laundry load Zs1 detected on the basis of the value measured by the strain gauge 20. That is, for wet laundry, a greater load is applied to the driving unit by the frictional action with the pulsator 4 and the entangling of the wet laundry.

After Step C140, a process for calculating the laundry load attained by excluding the amount of water contained in the laundry is performed. To this end, the water is supplied to the preset water level (C150). The washing machine of the embodiment is provided with an air chamber (not shown) communicating with the tub 2. As the water level of the tub 2 is gradually increased, it is determined if the water level of the tub 2 reaches the preset water level by detecting a pressure variation in the air chamber, thereby controlling the water supply.

Here, a water supply amount required for the water level in the tub 2 to reach the preset water level is a value known through a test. For example, the water supply amount required for the water level in the tub 2 to reach the preset water level can be measured by supplying the water in a state where a predetermined amount of the dry laundry is loaded in the drum 3. Therefore, the preset water level may be set to be low so that the laundry of the substantially same volume can be soaked regardless of the amount of the laundry loaded in the drum 3. A water level may be detected when the water level sensor is divided into water level sections and the water supply is controlled until the water level reaches a target water level. The preset water level may be set as a value corresponding to a minimum water level.

When the water level of the tub 2 reaches the preset water level and thus the supply of the water is stopped, a total amount of the wash water in the tub 2 becomes W1 regardless of whether the laundry loaded in the drum 3 is wet laundry or dry laundry because the water supply amount W1 consumed for the water level to reach the preset water level is known in advance.

After the water supply is stopped as the water level in the tub 2 reaches the preset water level, the load Zs2 is detected again by the strain gauge (C160).

After the above, a dry laundry load Zdry is calculated by a difference value between the load Zs2 detected in Step S60 and the water supply amount W1 required for reaching the preset water level (C170). A target water supply amount Wt1 is set according to the laundry load Zdry and the water supply process is performed (C180). Here, the target water supply amount Wt1 is a final amount of wash water stored in the tub 2 when the water supply is completed.

While the water is being supplied in Step C180, a load Zs3 is detected on the basis of a value measured by the strain gauge 20 (C190). The stopping of the water supply is determined according to a difference between the load Zs3 detected in Step C190 and the laundry load Zdry. That is, when the difference between Zs3 and Zdry is equal to or greater than the target water supply amount Wt1, it is determined that the water is filled in the tub 2 as much as the target water supply amount Wt1 and thus the water supply is stopped (C200 and C210).

On the other hand, when it is determined in Step C200 that the difference between the Zs3 and the Zdry is less than the target water supply amount Wt1, it is determined that the water is not yet filled in the tub 2 as much as the target water supply amount and the process is returned to Step C190.

Meanwhile, when it is determined that the laundry loaded in the drum 3 is dry laundry, i.e., when the Zp is not greater than the Zs1, a target water supply amount Wt2 is set according to the Zs1 and the water is supplied (C135).

While the water is being supplied in Step C135, a load Zs4 is detected again on the basis of a value measured by the strain gauge 20 (C145). The stopping of the water supply is determined according to a difference between the load Zs4 detected in Step C145 and the laundry load Zs1 detected in Step C120. That is, when the difference between the Zs4 and the Zs1 is equal to or greater than the target water supply amount Tt2, it is determined that the water is filled in the tub 2 as much as the target water supply amount Wt2 and thus the water supply is stopped (C155 and C210).

On the other hand, when it is determined in Step C155 that the difference between the Zs4 and the Zs1 is less than the target water supply amount Wt2, it is determined that the water is not yet filled in the tub 2 as much as the target water supply amount and the process is returned to Step C145.

A method of controlling a washing machine according to the embodiment of the invention is effective in that the degree of unbalance can be accurately detected.

In addition, the method of controlling the washing machine according to an embodiment of the invention is effective in that, because the degree of unbalance is detected in accordance with the variation of the load that is directly applied from the tub, the accuracy of the degree of unbalance detection can be greatly improved as compared with the prior art where the degree of unbalance was indirectly detected in accordance with the load applied to the driving unit.

In addition, the washing machine control method of the embodiment of the invention is effective in that the water supply amount can be accurately controlled.

In addition, the washing machine control method of the embodiment of the invention is effective in that the wash water can be accurately supplied as much as the preset amount without being affected by an outside source water supply pressure, which varies according to the places where the washing machine is installed.

In the above-described embodiments, the values Zs1, Zs2, Zs3, and Zs4 are values measured by the strain gauge 20. However, the values detected by the weight detecting sensor 120 may be also used.

Figure 29:
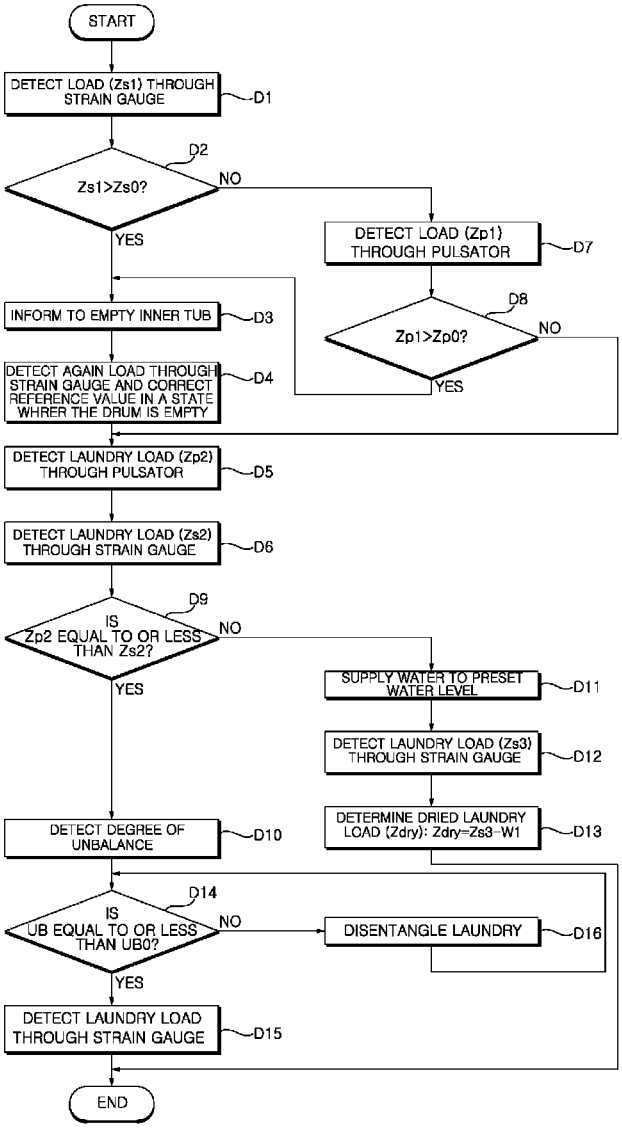
FIG. 29 is a flowchart illustrating a method of controlling a washing machine according to another embodiment of the invention.

FIG. 29 is a flowchart illustrating a method of controlling a washing machine according to an embodiment of the invention. The prior art washing machine goes through a process for detecting load in a state where the laundry is loaded in the drum during washing, rinsing, or spinning. Based on the load detected, the washing machine treats the laundry by applying preset washing pattern, rinsing pattern, or spinning pattern. Step D1 is different from a case where the laundry load is detected during the washing operation of the washing machine. Step D1 is for detecting the laundry load before the washing, rinsing, and spinning is performed. Accordingly, according to an order of operation in which, in a state where the drum is empty, a user turns on electric power and loads the laundry into the drum 3, and the washing is performed, Step D1 is a process for detecting the load in a state where the drum 3 is empty before the laundry is loaded and after the power is turned on.

In a load detection process that is performed during the washing, rinsing, and spinning the laundry load loaded in the drum 3, the load is determined by comparing a value measured by the strain gauge 20 with a reference value. The reference value is preset by reflecting an empty state of the drum 3. For example, the reference value may be a value measured by the strain gauge 20 in a test mode without the laundry loaded before the washing machine is released from a factory.

Because a load is continuously applied from the tub 2 to the tub support mount 30, fatigue of the tub support mount 30 is increased as time goes by after the washing machine is installed. The increase of the fatigue causes an aging effect. Therefore, a value measured by the strain gauge in an empty state of the drum 3 of an aged washing machine may be different from the reference value obtained before the washing machine was released from the factory. Therefore, there is a need to correct the reference value frequently.

The correction of the reference value is performed according to a value measured by the strain gauge 20 in an empty state of the drum 3. Therefore, in this embodiment of the invention, it is first determined if the drum 3 is empty. If the laundry is loaded in the drum 3, this state is informed to the user so that the user can empty the drum.

Step D2 is for determining if the drum 3 is empty. A load Zs1 detected in Step D1 is compared with a first preset value Zs0. Here, the first preset value Zs0 is the above-described reference value. The first preset value Zs0 is a preset value reflecting the empty state of the drum 3.

When the load Zs1 is greater than the first preset value Zs0, this means that the laundry is loaded in the drum 3 or the load detected by the strain gauge 20 is greater than the first preset value Zs0 due to the aging of the deformation member 40 although the drum is empty.

When the load Zs1 is greater than the first preset value Zs0, a message for emptying the drum 3 is output (D3). The message may be output in the form of sound by a speaker or a buzzer or visually displayed through a display unit such as a liquid crystal display, a light emitting diode, and the like.

After the above, the load is detected again by the strain gauge 20 and the controller 11 corrects the first preset value based on the detected load (D4). Step D4 may be performed after sufficient time for allowing the user to identify if the laundry is loaded in the drum 3 and unload the laundry passes or performed in accordance with a control signal informing the controller 11 of the empty state of the drum 3.

Meanwhile, when Zs1 is equal to or less than Zs0 in Step D2, the load is detected again using the pulsator 4 (D7). When Zs1 is equal to or less than Zs0, it can be regarded that the deformation member 40 is not aged and thus there is no need to correct the reference value or that an amount of the laundry loaded in the drum 3 is too small and thus the laundry is not detected by the strain gauge 20.

Accordingly, in Step D7, when the laundry load in the drum 3 is small, the pulsator 4 that can more accurately detect the load than the strain gauge 20; therefore, the pulsator 4 is used to further measure the load. Because the detection of the load by the strain gauge 20 is done by the deformation of the deformation member 40, the detection accuracy of the strain gauge 20 is deteriorated when the laundry load in the drum 3 is too small. However, when the load is measured using the pulsator 4, the detection accuracy of the load can be more improved than the case where the strain gauge 20 is used because the variation of the rotational property of the pulsator is detected even when the laundry load in the drum 3 is small.

In Step D8, a load Zp1 detected in Step D7 is compared with a second preset value Zp0. Here, the second preset value Zp0 is a load that is detected as the rotational property of the pulsator 4 varies when the pulsator 4 rotates in a state where the drum 3 is empty.

When Zp1 is greater than Zp0, it is regarded that the laundry is loaded in the drum 3; a message for emptying the drum 3 is output D3. On the other hand, when Zp1 is less than or equal to Zp0, it is regarded that the drum 3 is empty. Therefore, the process is returned to Step D5. Step D5 will be described in more detail later.

Steps D5, D6, and D9 are for allowing the user to determine if the laundry loaded in the drum 3 is dry laundry or wet laundry.

The laundry load Zp2 is detected while alternately rotating the pulsator 4 in both directions (D5). Here, the laundry load is detected on the basis of the rotational property of the pulsator 4. For example, the typical washing machine can detect the laundry load in accordance with a characteristic where a rotational speed (as measured in RPM) of the driving unit 13 varies differently in accordance with the laundry load as the RPM of the driving unit 13 reaches a predetermined RPM. Alternatively, the typical washing machine can detect the laundry load in accordance with a characteristic where an RPM variation of the driving unit 13 varies in accordance with the laundry load when putting on the brakes on the driving unit 13 while rotating the driving unit 13 rotates at a predetermined RPM. Alternatively, the typical washing can calculate the laundry load according to a time taken for the RPM of the driving unit to reach a predetermined RPM or for stopping the driving unit 13 rotating at a predetermined RPM.

Additionally, at Step D6, the laundry load is detected on the basis of a value measured by the strain gauge 20. After this, the controller 11 compares the laundry load Zp2 detected in Step D5 with the laundry load Zs2 detected in Step D6 to determine if the laundry loaded in the drum 3 is dry laundry or wet laundry.

Describing Step D9 in more detail, the laundry load detected based on the rotational property of the pulsator 4 in Step D5 and the laundry load detected based on the value measured by the strain gauge 20 in Step D6 are different from each other in a case where dry laundry is loaded in the drum and a case where wet laundry is loaded in the drum. That is, when the wet laundry is loaded in the drum 3, the laundry load Zp2 detected on the basis of the rotational property of the pulsator 4 is greater than the laundry load Zs2 detected on the basis of the value measured by the strain gauge 20. That is, for wet laundry, a greater load is applied to the driving unit by the frictional action with the pulsator 4 and the entangling of the wet laundry.

In Step D9, when it is determined that dry laundry is loaded (i.e., Zp2 is equal to or less than Zs2), a degree of unbalance (UB) is detected (D10). The detected degree of unbalance UB is compared with an allowable value UB0 (D14). When the UB is equal to or less than UB0, the laundry load is detected (D15). Here, a high degree of unbalance means that the laundry is not evenly distributed in the drum 3.

The degree of unbalance can be detected through a variety of methods. For example, the degree of unbalance can be detected on the basis of an output signal from the strain gauge 20 when the drum rotates. That is, as the drum 3 rotates in an unbalanced state, intensity of the output signal of the strain gauge 20 is increased or reduced periodically. This pattern varies in accordance with the degree of unbalance, through which the controller 11 determines the degree of unbalance.

When the UB is greater than UB0 in Step D14, disentangling of the laundry is performed (D16). The disentangling D16 allows the laundry to be uniformly dispersed by alternately rotating the pulsator 4 and/or the drum 3 in the both directions.

Meanwhile, when the Zp2 is greater than the Zs2 in Step D9, the controller 11 determines that wet laundry is loaded in the drum 3 and performs Steps D11, D12, and D13 to determine the dry laundry load excluding an amount of the water contained in the laundry.

Step D11 is for supplying the water into the tub 2 to a preset water level. The washing machine according to an embodiment of the invention is provided with an air chamber (not shown) communicating with the tub 2. As the water level of the tub 2 is gradually increased, it is determined if the water level of the tub 2 reaches the preset water level by detecting a pressure variation in the air chamber, thereby controlling the water supply.

Here, a water supply amount required for the water level in the tub 2 to reach the preset water level is a value known through a test. For example, the water supply amount required for the water level in the tub 2 to reach the preset water level can be measured by supplying the water in a state where a predetermined amount of the dry laundry is loaded in the drum 3. Therefore, the preset water level may be set to be low so that the laundry of the substantially same volume can be soaked regardless of the amount of the laundry loaded in the drum 3. A water level may be detected when the water level sensor is divided into water level sections and the water supply is controlled until the water level reaches a target water level. The preset water level may be set as a value corresponding to a minimum water level.

When the water level of the tub 2 reaches the preset water level and thus the supply of the water is stopped, a total amount of the wash water in the tub 2 becomes W1 regardless of whether the laundry loaded in the drum 3 is wet or dry because the water supply amount W1 consumed for the water level to reach the preset water level is known in advance.

After the water supply is stopped as the water level in the tub 2 reaches the preset water level, the load is detected again by the strain gauge (D12).

After the above, a dry laundry load Zdry is calculated by a difference value between the load Zs3 detected in Step D12 and the water supply amount W1 required for reaching the preset water level (D13).

As described above, the washing machine control method according to an embodiment of the invention includes Steps D1, D4, D6, D12, and D15 for detecting the load or laundry load using the strain gauge 20. In each of Steps D1, D4, D6, D12, and D15, the controller 11 determines the load or laundry load based on the strain detected by the strain gauge 20. A process for determining the load or laundry load by the controller 11 will be described in more detail hereinafter.

At this point, it is significant that the following description can be applied to any one of Steps D1, D4, D6, D12, and D15. However, for the descriptive convenience, Step D15 will be exemplarily described as a process for detecting the laundry load.

Step D15 is for detecting a deformation value of the tub support mount 30 during the rotation of the drum 3 and determining the laundry load based on the detected deformation value. A deformation value of the tub support mount 30 is determined through a through evaluation of the deformation of the deformation member 40, which is detected by the strain gauge 20. The controller 11 determines the laundry load based on the strain detected through the strain gauge 20 during the rotation of the drum 3.

In the above, the values Zs1, Zs2, and Zs3 are values measured by the strain gauge 20. However, the values detected by the weight detecting sensor 120 may be also used.

Figure 30:
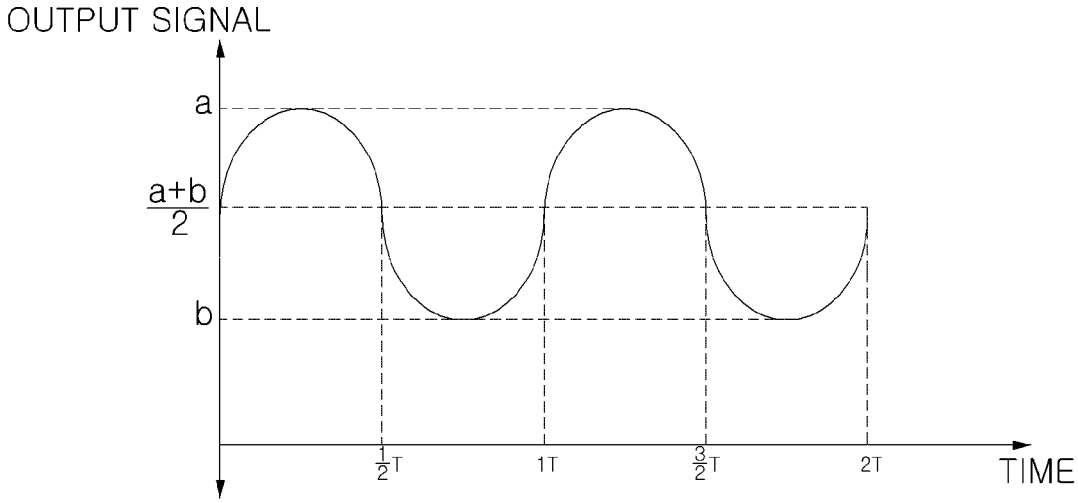
FIG. 30 is a signal wave output from a stain gauge during rotation of a drum in accordance with an embodiment of the invention.

A signal wave output by the strain gauge 20 during the rotation of the drum in a washing machine in accordance with an embodiment of the invention is shown in FIG. 30. Referring to FIG. 30, the controller 11 monitors the strain gauge 20 as the strain gauge 20 measures the strain of the deformation member 40 during the rotation of the drum 3. The output signal from the strain gauge 20 is input to the controller 11.

If the laundry is uniformly dispersed in the drum 3, an output signal from the strain gauge 20 uniformly remains during the rotation of the drum 3. However, it is very difficult to allow the laundry to be optimally uniformly dispersed in the drum 3. Therefore, the drum 3 in which the laundry is loaded rotates in an unbalanced state to some degree. Accordingly, the output signal from the strain gauge 20 forms a sine wave having a period (T) as shown in FIG. 30.

When the output signal from the strain gauge 20 is applied to the controller during the rotation of the drum 3, the controller 11 finds the mean of the output signal and determines the laundry load based on the mean.

The controller may determine the laundry load based on a mean value of a maximum value (a) and a minimum value (b) of the output signal output in at least one cycle (e.g., from 1T to 2T).

Meanwhile, the controller 11 may exclude values output from the strain gage 20 for a predetermined cycle or a predetermined time after the drum 3 starts rotating. This is because that it takes a predetermined time until the drum is accelerated and stably rotates. Likewise, values output from the strain gage for a predetermined cycle or a predetermined time until the drum 3 stops after the brakes are engaged may be also excluded.

Meanwhile, the controller 11 finds mean values of the output signal from the strain gauge 20 per each cycle in a section of at least two cycles and further finds a mean value of the mean values. Based on this mean value, the controller 11 determines the laundry load.

Considering the above-described conditions, after the drum 3 starts rotating, a process for determining the laundry load by the controller 11 using the output signal from the strain gauge 20 for a time of 10T will be exemplarily described hereinafter.

First, values between 0 to 3T, which correspond to values in an initial driving of the drum 3 are excluded. A mean value m between 3T and 7T is calculated. Because values between 7T and 10T correspond to values while the drum 3 is being stopped, they are excluded.

The controller 11 determines the laundry load based on the mean value m. Here, the mean value m may be attained by finding a mean value of the mean value m1 between 3T and 4T, the mean value m2 between 4T and 5T, and the mean value m3 between 6T and 7T.

The washing machine control method according to an embodiment of the invention is effective in that, because the laundry load is determined by finding the mean of the output signal from the strain gauge, the laundry load can be accurately detected even when the drum rotates in an unbalanced state.

Meanwhile, in order to more accurately detect the degree of unbalance, the washing machine of the invention may use two strain gauges that are diagonally disposed. This configuration was discussed with reference to FIG. 24, above. Accordingly, it will not be repeated.

Additionally, because the process of calculating the first and second mean values is substantially same as the process for calculating the laundry load using one strain gage 20, the detailed description thereof will be omitted herein. Alternatively, it is also possible to attain the first and second mean values based on values detected by the weight detecting sensor 120.

The washing machine and washing machine control method of the embodiments of the invention are effective in that the laundry load can be accurately detected even when the laundry is not uniformly dispersed in the drum.

In addition, the washing machine and washing machine control method of the embodiments of the invention are effective in that, because the degree of unbalance is detected in accordance with the variation of the load that is directly applied from the tub, the accuracy of the laundry load detection can be greatly improved as compared with the prior art where the degree of unbalance is indirectly detected in accordance with the load applied to the driving unit.

The invention relates to a method of controlling a washing machine having a tub and a drum rotatably disposed in the tub. It is determined whether additional spinning is performed or not by measuring a degree of water removal by measuring a weight of the laundry, from which water is removed through a spin cycle, using a weight detecting sensor provided on a suspension supporting the tub after a weight of the laundry loaded in the drum is measured before the water is supplied in a wash cycle.

Figure 31:
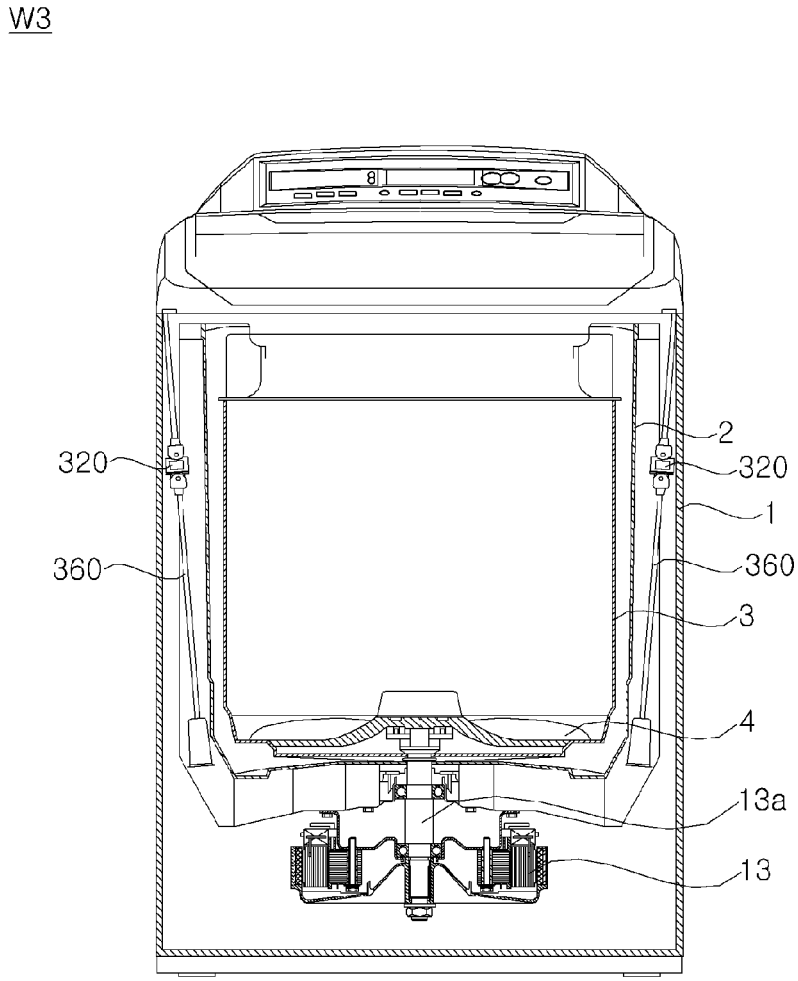
FIG. 31 is a schematic view of a washing machine according to another embodiment of the invention.

FIG. 31 is a schematic view of a washing machine according to another embodiment of the invention. Referring to FIG. 31, the washing machine W3 includes a casing 1 defining an appearance of the washing machine, a tub 2 disposed in the casing 1, and a drum 3 that is rotatably provided in the tub 2. A pulsator 4 is provided under the drum 3. The drum 3 and the pulsator 4 are connected to and driven by a vertical washing shaft 13*a* connected to a driving unit 13.

The casing 1 is formed in a rectangular parallelepiped box shape and provided with a door through which the laundry is loaded and unloaded. The tub 2 is formed in a cylindrical shape having an opened top and suspended in the casing 1 by a supporting member 360.

Figure 32:
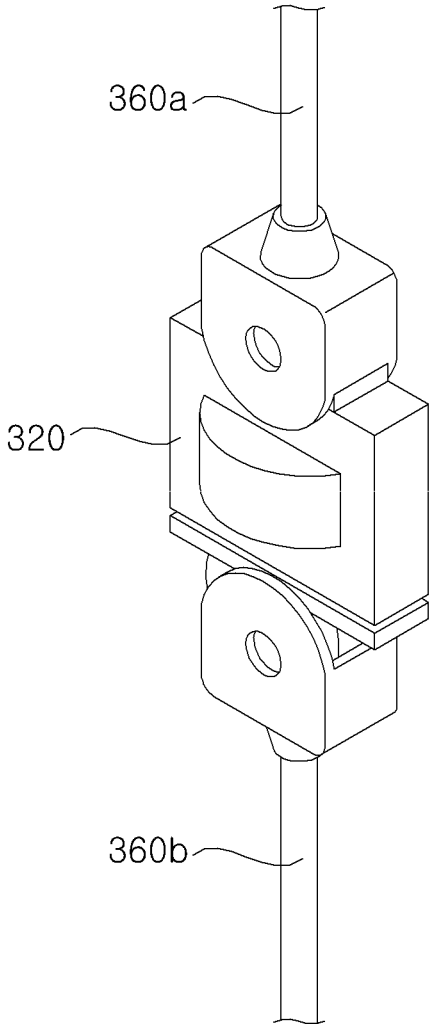
FIG. 32 is a schematic view of a load cell provided on the washing machine of FIG. 31.

The supporting member 360 may be provided with a load cell, or weight detecting sensor 320, that can detect weight using tensile force. A load cell 320 is illustrated in FIG. 32. In FIG. 32, the supporting member 360 (FIG. 31) is divided into upper and lower bars 360*a* and 360*b* and the load cell 320 is mounted between the upper and lower bars 360*a* and 360*b*.

Meanwhile, a controller (not shown) is provided on the washing machine W3. The controller controls the driving motor rotating the drum 3 to determine an RPM of the drum 3.

Figure 33:
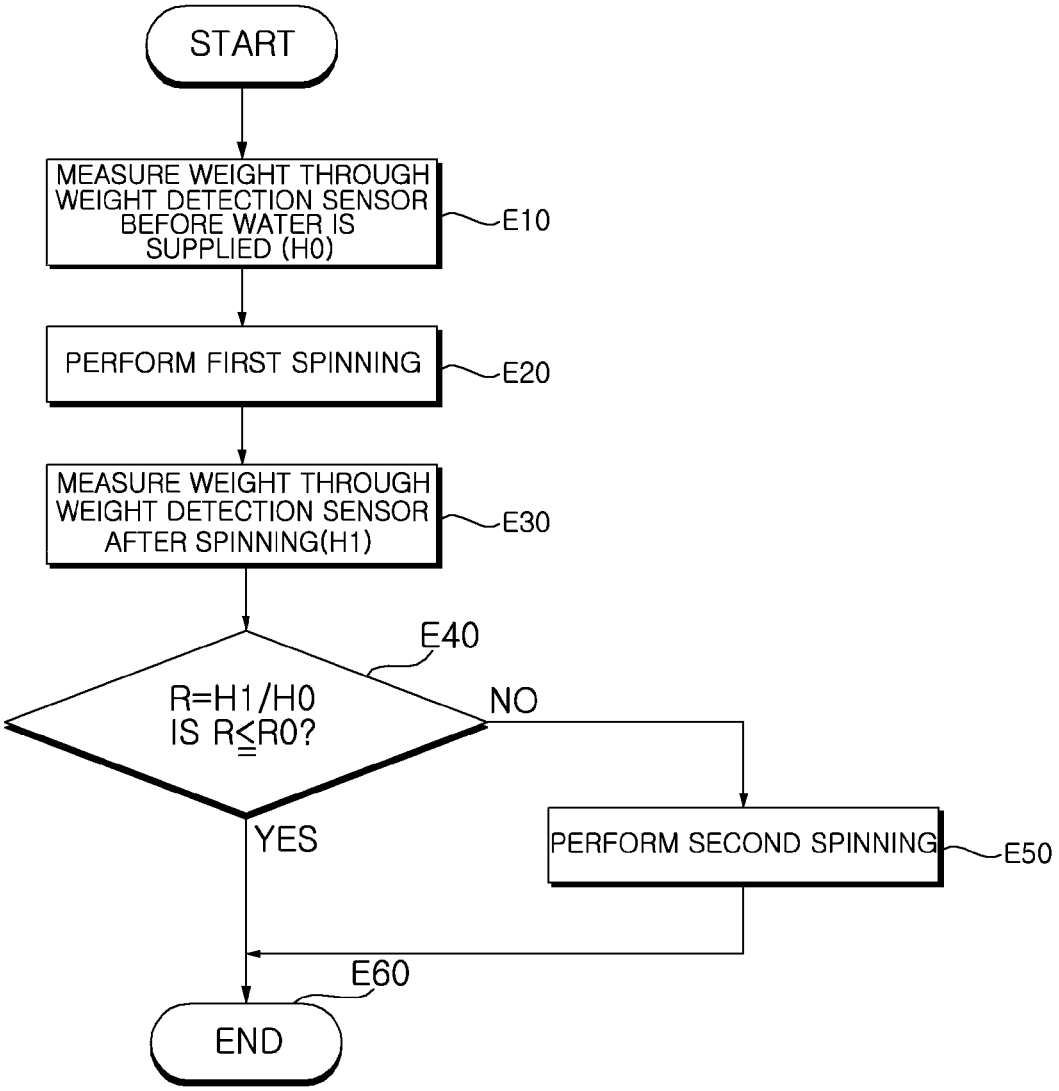
FIG. 33 is a flowchart illustrating a method of controlling the washing machine of FIG. 31 according to an embodiment of the invention.

FIG. 33 is a flowchart illustrating a method of controlling the washing machine of FIG. 31 according to an embodiment of the invention. Referring to FIG. 33, the method includes measuring a weight (H0) of laundry loaded in the drum 3 using the weight detecting sensor 320 provided on the supporting member 360 suspending the tub 2 before washing, that is before water is supplied (E10), performing first spinning for removing water from the laundry (E20), measuring a weight (H1) of the laundry after the first spinning is performed (E30), determining if additional spinning will be performed by comparing the weight H0 with the weight H1 (E40) to determine a degree of water removal (R), where R=H1/H0, performing a second spinning when the degree of water removal R of the laundry gone through the first spinning does not reach a reference degree of water removal R0 (E50).

In Step E10, the weight of the laundry loaded in the drum 3 is measured by the weight detecting sensor 320 provided on the supporting member 360 suspending the tub 2 before the water is supplied. According to the embodiment of the invention, the performing of the additional spinning is determined on the basis of the degree of water removal of the laundry. A variety of methods may be used to measure the degree of water removal. In this embodiment, the degree of water removal is measured by comparing the weight of the laundry before the washing cycle (H0) and the weight of the laundry after the spin cycle (H1). That is, the degree of water removal is a ratio of a weight of water remaining in the laundry to the weight of the laundry when it was in a dry state before the water was supplied. Accordingly, Step E10 is for measuring the weight of the laundry that is in the dry state before the water is supplied in the wash cycle.

Here, the load cell is used as the weight detecting sensor 320 provided on the supporting member 360 to measure the weight of the laundry. However, the invention is not limited to this. That is, for the washing machine W1 described with reference to FIGS. 1 to 14, the deformation detecting sensor or strain gauge 20 may be used.

The load cell 320 is located above a middle portion of the supporting member 360 to measure the weight of the laundry by detecting tensile force applied by the weight of the tub 2 including the drum 3 and the laundry.

Step E20 is for firstly removing the water from the laundry in the spin cycle. The water is removed from the laundry by centrifugal force of the drum 3. However, in Step E20, the laundry may not reach the reference degree of water removal, as the water is not sufficiently removed from the laundry. Therefore, the following steps are required.

In Step E30, the weight H1 of the laundry from which the water is firstly removed is measured by the weight detecting sensor 320. The detection of the weight of the laundry in Step E30 is same as in Step E10.

In step E40, it is determined if the additional spinning will be performed by comparing the weight H0 with the weight H1. The degree of water removal (R) of the laundry after the spinning is measured through the weight of the laundry, which is measured in Step E30. When the degree of water removal R after the first spinning does not reach the reference degree of water removal, R0, a second spinning to further remove the water from the laundry is performed. Thereafter the spinning is ended (E60).

That is, Step E50 is for further removing the water from the laundry gone through the first spinning when the degree R did not reach the reference degree R0.

Here, a variety of methods for removing the water from the laundry may be used. For example, in Step E50, a spinning time t is determined in proportion to a degree by which the degree R of the laundry gone through the first spinning exceeds the reference degree R0.

Alternatively, the RPM of the drum 3 may vary in proportion to the degree by which the degree R of the laundry gone through the first spinning exceeds the reference degree R0. Here, the RPM of the drum in the second spinning may be 830 RPM or more. This can allow the spinning to be performed as fast as it can and thus the spinning time can be reduced.

Figure 34:
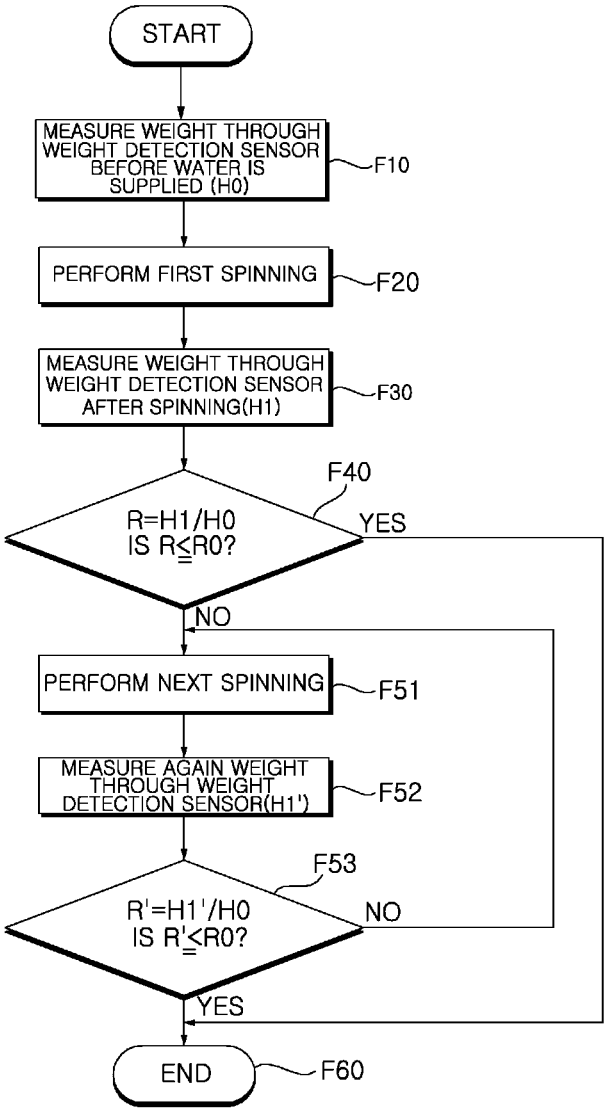
FIG. 34 is a flowchart illustrating a method of controlling the washing machine of FIG. 31 according to another embodiment of the invention.

FIG. 34 is a flowchart illustrating a method of controlling the washing machine of FIG. 31 according to another embodiment of the invention. Referring to FIG. 34, the method includes measuring a weight (H0) of laundry loaded in the drum 3 using the weight detecting sensor 320 provided on the supporting member 360 suspending the tub 2 before washing, that is before water is supplied (F10), performing first spinning for removing water from the laundry (F20), measuring a weight (H1) of the laundry after the first spinning is performed (F30), determining if additional spinning will be performed by comparing the weight H0 with the weight H1 to determine a degree of water removal (R), where R=H1/H0 (F40), performing a second spinning when the degree of water removal R of the laundry gone through the first spinning does not reach a reference degree of water removal R0 (F51), measuring again the weight (H1') of laundry loaded in the drum 3 using the weight detecting sensor 320, determining again if additional spinning will be performed by comparing the weight H0 with the weight H1' to determine a degree of water removal (R'), where R'=H1'/H0 and if R' is not equal to or less that R0 repeatedly repeating steps F51 and F52 again until R is equal to or less than R0 (F53), and when R is equal to or less than R0, the spinning is ended (F60).

Because Steps F10, F20, F30, and F40 are same as Steps E10, E20, E30, and E40 of the foregoing embodiment (FIG. 33), the detailed description thereof will be omitted herein. In addition, when the control method of this embodiment is applied to the washing machine W1 described with reference to FIGS. 1 to 14, the deformation detecting sensor or strain gauge 20 may be used.

Steps F51, F52, and F53 are for additionally removing the water from the laundry when the degree R of water removal of the laundry gone through a first spinning F20 and subsequent spinnings (see "NO" branch of F53) cannot reach the reference degree R0 of water removal.

Here, Steps F51, F52, and F53 are repeated so long as the degree R cannot reach the reference degree R0. Accordingly, by repeating the spinning and measurement, the water remaining in the laundry and the degree of water removal after each spinning is measured and, according to this embodiment, additional spinning can be further performed.

According to the above-described embodiments, because the degree of water removal of the laundry is measured and the additional spinning is automatically determined and performed on the basis of the measured degree of water removal, user convenience can be improved. In addition, because the spinning is performed on the basis of the accurate degree of water removal, the washing efficiency is improved.

In addition, because the spinning is performed after the degree of water removal of the individual laundry is measured and the additional amount of water to be removed is determined based on the degree of water removal measured, the convenience is provided and the damage of the laundry can be prevented.

Meanwhile, in the above description, the deformation detecting sensor (or strain gauge) 20 or the weight detecting sensor 120 are exemplarily used to detect a property varying in accordance with a vertical load applied by the tub 2. However, it may be also considered that a solenoid device having a core that moves within a coil in accordance with the vertical load applied by the tub 2 may be used to attain inductance in accordance with the movement of the core.

Alternatively, a vertical displacement of the tub 2, which varies in accordance with the vertical load applied by the tub 2, may be measured. That is, as the amount of the laundry is increased, the downward displacement of the tub 2 is increased. Therefore, the laundry load can be detected by measuring the downward displacement of the tub 2. To realize this, an optical sensor that uses infrared rays or laser beams to measure the displacement of the tub 2 may be used.

It will be apparent to those skilled in the art that various modifications and variation can be made in the invention without departing from the spirit or scope of the invention.

Thus, it is intended that the invention cover the modifications and variations of this invention provided they come within the scope of the appended claims and their equivalents.

What is claimed is:

1. A method of controlling a washing machine comprising a casing, a tub suspended in the casing, a drum rotatably provided in the tub, a pulsator rotatably provided in the drum, and a driving unit rotating the pulsator, the method comprising:

(a) controlling the driving unit to rotate the pulsator while a certain amount of laundry is being provided in the drum;

(b) measuring a first property that varies in accordance with a resistant load applied to the driving unit while the pulsator is being rotated;

(c) calculating a first laundry load based on the first property;

(d) measuring a second property that varies in accordance with a vertical load applied by the tub while the certain amount of laundry is being provided in the drum;

(e) calculating a second laundry load based on the second property;

(f) determining that the laundry provided in the drum is in a dry state when the first laundry load calculated in (c) and the second laundry load calculated in (e) are substantially identical values; and (g) determining that the laundry provided in the drum is in a wet state when a difference between the first laundry load calculated in (c) and the second laundry load calculated in (e) is equal to or greater than a predetermined value.

2. The method of claim 1, further comprising:

(h) supplying wash water into the tub to a predetermined water level when it is determined that the laundry in the drum is in the wet state;

(i) calculating a third laundry load by performing (d) and (e) again while the tub is being filled with the wash water supplied in (h); and (j) calculating a dry laundry load based on the third laundry load and an amount of the wash water supplied in (h).

3. The method of claim 2, wherein a target water level for washing or rinsing is set in accordance with the dry laundry load.

4. The method of claim 2, wherein a rotational speed of the drum or the pulsator is set in accordance with the dry laundry load.

5. The method of claim 1, wherein the second laundry load is calculated on the basis of a degree to which a tub support mount, on which a suspension supporting the tub suspended from the casing, is deformed by the load applied to the tub support by the tub.

6. The method of claim 1, wherein the second property is measured by a weight detecting sensor coupled to a suspension supporting the tub suspended from the casing.

7. The method of claim 1, further comprising:

when it is determined that the laundry in the drum is in the wet state, outputting a message indicating that wet laundry is loaded in the drum.

8. The method of claim 7, wherein the message is output in the form of a sound.

9. The method of claim 7, wherein the message is visually displayed.

10. The method of claim 1, further comprising:

before (a), measuring the second property; and outputting a message indicative of a request to empty the drum when the second property is greater than a first preset value.

11. The method of claim 10, further comprising:

when the second property measured before (a) is less than the first preset value, measuring the first property before (a); and outputting a message indicative of a request to empty the drum when the first property measured before (a) is greater than a second preset value.

12. The method of claim 1, further comprising:

determining a degree of unbalance based on the second property that varies in accordance with the vertical load applied by the tub.

13. The method of claim 1, further comprising:

(h) supplying wash water into the tub after (c);

(i) performing a first spinning by rotating the drum after (h) such that wash water is extracted from the laundry;

(j) performing (d) and (e) again;

(k) obtaining a degree of water removal by comparing another laundry load obtained in (j) and the first laundry load obtained in (c); and (l) a second spinning by rotating the drum such that wash water is extracted from the laundry when the degree of water removal is less than a reference degree of water removal.

14. The method of claim 13, wherein a spinning time of the second spinning is determined in proportion to a degree to which the degree of water removal exceeds the reference degree of water removal.

* * * * *